US010410567B2

(12) United States Patent
Nakagoshi

(10) Patent No.: US 10,410,567 B2
(45) Date of Patent: Sep. 10, 2019

(54) DISPLAY SIGNAL PROCESSING SYSTEM, DISPLAY SIGNAL GENERATION DEVICE, DISPLAY DEVICE, PROCESSING METHOD, DISPLAY SIGNAL GENERATION METHOD, AND DISPLAY METHOD

(71) Applicant: JVC KENWOOD Corporation, Yokohama-shi, Kanagawa (JP)

(72) Inventor: Ryosuke Nakagoshi, Yokohama (JP)

(73) Assignee: JVCKENWOOD Corporation, Yokohama-shi, Kanagawa (JP)

( * ) Notice: Subject to any disclaimer, the term of this patent is extended or adjusted under 35 U.S.C. 154(b) by 148 days.

(21) Appl. No.: 15/669,793

(22) Filed: Aug. 4, 2017

(65) Prior Publication Data

US 2017/0330499 A1 Nov. 16, 2017

Related U.S. Application Data

(63) Continuation of application No. PCT/JP2016/000075, filed on Jan. 8, 2016.

(30) Foreign Application Priority Data

Feb. 10, 2015 (JP) ..... 2015-023827
Dec. 2, 2015 (JP) ..... 2015-235421

(51) Int. Cl.
*G09G 3/20* (2006.01)
*G09G 3/00* (2006.01)
(Continued)

(52) U.S. Cl.
CPC ..... *G09G 3/2003* (2013.01); *G09G 3/001* (2013.01); *G09G 3/003* (2013.01); *G09G 3/2096* (2013.01);
(Continued)

(58) Field of Classification Search
USPC ..... 345/589
See application file for complete search history.

(56) References Cited

U.S. PATENT DOCUMENTS

2007/0252795 A1* 11/2007 Shiomi ..... G09G 3/2048 345/87
2010/0315443 A1* 12/2010 Furukawa ..... G09G 3/3648 345/690
(Continued)

FOREIGN PATENT DOCUMENTS

JP 2007-266667 A 10/2007
JP 2007-310045 A 11/2007
WO 2014203869 A1 12/2014

*Primary Examiner* — Wesner Sajous
(74) *Attorney, Agent, or Firm* — Procopio, Cory, Hargreaves & Savitch LLP

(57) ABSTRACT

A display signal processing system according to the embodiment includes: a processing device configured to generate transmission data; an interface unit configured to transmit the transmission data; and a display unit configured to generate a display signal based on the transmission data. The processing device includes a SDR conversion unit configured to generate low-bit video data by decimating gradations of the video signal; an additional data calculation unit configured to generate additional data on the basis of information of the decimated gradations; and a mapping unit configured to generate the transmission signal including the low-bit video data and the additional data. The display unit includes a processor configured to restore at least a part of the decimated gradations in the low-bit video data on the basis of the transmission signal to thereby generate a display signal.

9 Claims, 21 Drawing Sheets

(51) Int. Cl.
*G09G 3/36* (2006.01)
*G09G 5/00* (2006.01)

(52) U.S. Cl.
CPC ..... *G09G 3/36* (2013.01); *G09G 5/006* (2013.01); *G09G 5/005* (2013.01); *G09G 2320/0233* (2013.01); *G09G 2320/0276* (2013.01); *G09G 2340/0428* (2013.01); *G09G 2340/10* (2013.01); *G09G 2370/04* (2013.01)

(56) References Cited

U.S. PATENT DOCUMENTS

| | | | | |
|---|---|---|---|---|
| 2011/0057970 | A1* | 3/2011 | Inokawa ..... | G09G 3/20 345/698 |
| 2012/0223977 | A1* | 9/2012 | Inada ..... | G09G 3/3611 345/690 |
| 2013/0176489 | A1* | 7/2013 | Yamaguchi ..... | H04N 19/186 348/453 |

* cited by examiner

| IN | OUT |
|---|---|
| 0 | 0.100 |
| 1 | 0.160 |
| 2 | 0.220 |
| 3 | 0.280 |
| 4 | 0.340 |
| 5 | 0.400 |
| 6 | 0.460 |
| 7 | 0.520 |
| 8 | 0.580 |
| 9 | 0.640 |
| 10 | 0.700 |
| 11 | 0.760 |
| 12 | 0.820 |
| 13 | 0.880 |
| 14 | 0.940 |
| 15 | 1.000 |

Fig. 16

DISPLAY SIGNAL PROCESSING SYSTEM, DISPLAY SIGNAL GENERATION DEVICE, DISPLAY DEVICE, PROCESSING METHOD, DISPLAY SIGNAL GENERATION METHOD, AND DISPLAY METHOD

CROSS REFERENCE TO RELATED APPLICATION

This application is continuation application of PCT application No. PCT/JP2016/000075, filed Jan. 8, 2016, which claims the benefit of priority from Japanese patent application No. 2015-023827, filed on Feb. 10, 2015 and Japanese patent application No. 2015-235421, filed on Dec. 2, 2015 the disclosures of which are incorporated herein in its entirety by reference.

BACKGROUND

The present invention relates to a display signal processing system, a display signal generation device, a display device, a processing method, a display signal generation method, and a display method.

In recent years, there has been developed a display device that displays an HDR (High Dynamic Range) video. Note that a dynamic range is a ratio between the brightest point and the darkest point. Although in a usual liquid crystal display, a luminance is 100 cd/m$^2$, and a dynamic range (a contrast ratio) is approximately 1000 to 1, in an HDR display, for example, the luminance is 1000 cd/m$^2$, and the dynamic range is 50000 to 1.

Therefore, although each of RGB is 8 bits (256 gradations) in a usual display system, it is necessary to handle higher-bit video data than 8 bits in an HDR video display system. This is because 256 gradations are insufficient to represent a range of 50000 to 1. For example, it becomes necessary to handle video data of 16 bits, 32 bits, etc. in a video of an HDR camera, and CG (Computer Graphics) videos, such as Open-EXR.

In order to display such HDR videos, an HDR-compliant display (display device) is needed. Further, it is necessary to transmit high-bit video data to the HDR-compliant display.

SUMMARY

However, in a case where data is transmitted to a display from a personal computer, a camera, etc., input-output interfaces are limited. For example, in a usual personal computer, data is transmitted to a display through general-purpose interfaces, such as an HDMI (a registered trademark) (High Definition Multimedia Interface), a DisplayPort, a DVI (Digital Visual Interface), and an SDI (Serial Digital Interface). However, in a case of using the general-purpose interface, there is a problem that data having the higher number of bits than standards of the interface cannot be transmitted.

A display signal processing system according to the exemplary embodiment includes: a processing device configured to process a video signal to generate a transmission signal; an interface unit configured to transmit the transmission signal; and a display signal generation device configured to generate a display signal based on the transmission signal, wherein the processing device includes: a converter configured to generate low-bit video data by decimating gradations of the video signal; an additional data calculation unit configured to generate additional data on the basis of information of the decimated gradations; and a mapping unit configured to generate the transmission signal including the low-bit video data and the additional data, and the transmission signal being compliant with the interface unit, and the display signal generation device includes a processing unit configured to restore at least a part of the decimated gradations in the low-bit video data on the basis of the transmission signal to thereby generate a display signal.

A processing device according to the exemplary embodiment includes: a converter configured to generate low-bit video data by decimating gradations of a video signal; an additional data calculation unit configured to generate additional data on the basis of information of the decimated gradations; and a mapping unit configured to generate a transmission signal including the low-bit video data and the additional data, and the transmission signal being compliant with an interface unit.

A display signal generation device according to the exemplary embodiment includes: a processing unit configured to restore at least a part of decimated gradations of a video data to thereby generate a display signal, based on the video data from which gradations have been decimated, and additional data including information on the decimated gradations, the video data and the additional data being input from an outside.

A display device according to the exemplary embodiment includes: a processing unit configured to restore at least a part of decimated gradations of a video data to thereby generate a display signal, based on the video data from which gradations have been decimated, and additional data including information on the decimated gradations, the video data and the additional data being input from an outside; a display unit configured to display a video; a luminance adjustment unit configured to adjust a luminance of the video to be displayed on the display unit; and a plurality of display elements configured to perform gradation display of the video to be displayed on the display unit, wherein the processing unit is configured to divide the display signal into high-order-bit-side data and low-order-bit-side data, the luminance adjustment unit is configured to adjust the luminance of the video based on the high-order-bit-side data, and the display elements are configured to perform gradation display of the video based on the low-order-bit-side data.

A display signal processing method according to the exemplary embodiment includes: generating low-bit video data by decimating gradations of a video signal; generating additional data on the basis of information of the decimated gradations; generating a transmission signal that includes the low-bit video data and the additional data, and the transmission signal being compliant with an interface unit; and restoring at least a part of the decimated gradations in the low-bit video data on the basis of the transmission signal to thereby generate a display signal.

A processing method according to the exemplary embodiment includes generating low-bit video data by decimating gradations of a video signal; generating additional data on the basis of information of the decimated gradations; and generating a transmission signal that includes the low-bit video data and the additional data, and the transmission signal being compliant with an interface unit.

A display signal generation method according to the exemplary embodiment includes: restoring at least a part of decimated gradations of a video data to thereby generate a display signal, based on the video data from which gradations have been decimated, and additional data including information on the decimated gradations, the video data and the additional data being input from an outside.

A display method according to the exemplary embodiment includes: restoring at least a part of decimated gradations of a video data to thereby generate a display signal, based on the video data from which gradations have been decimated, and additional data including information on the decimated gradations, the video data and the additional data being input from an outside; dividing the display signal into high-order-bit-side data and low-order-bit-side data; adjusting a luminance of a video to be displayed on a display unit, based on the high-order-bit-side data; and performing gradation display of the video to be displayed on the display unit, based on the low-order-bit-side data.

BRIEF DESCRIPTION OF THE DRAWINGS

FIG. 16 is a table showing values of a control signal and opening ratios of a diaphragm;

DETAILED DESCRIPTION

<HDR Display>

Figure 1:
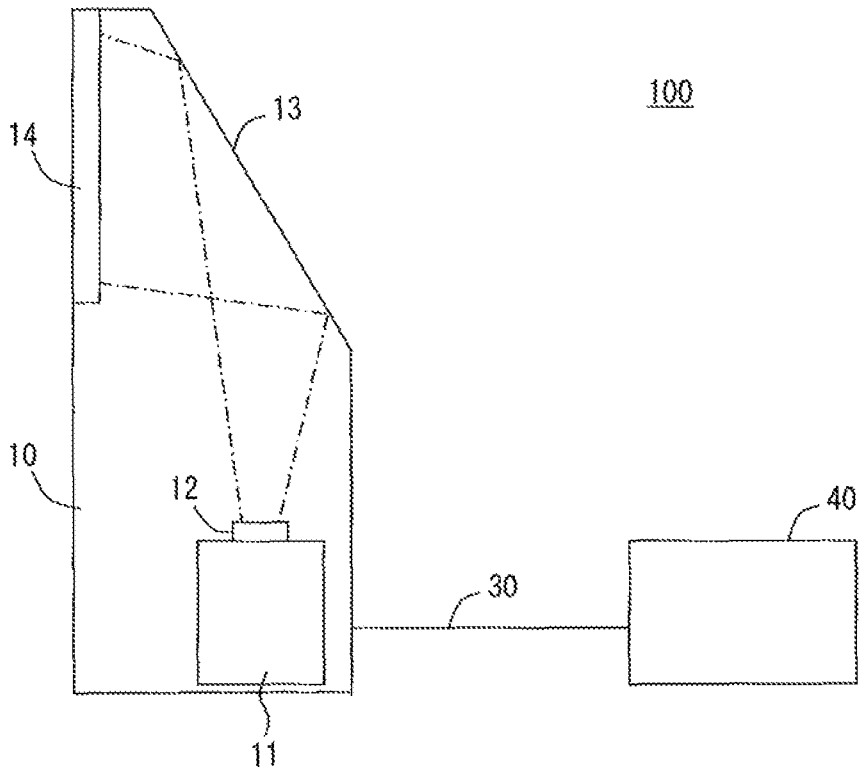
FIG. 1 is a diagram showing an overall configuration of an HDR-compliant display system.

A display system according to the embodiment is a display system that displays an HDR video. In FIG. 1, there is shown an overall configuration of the display system. The display system includes: a projector 10; an interface unit 30; and a processing device 40.

The projector 10 is an HDR-compliant display (display device), and displays a video of a moving image or a still image. For example, the projector 10 displays a video based on a display signal of 16-bit RGB. That is to say, gradations of 0 to 65535 are displayed in each pixel of the RGB of the projector 10. Note that in the following explanation, the number of bits of data or signal serves as a value indicating a gradation value of each pixel of the RGB.

The projector 10 is a rear-projection-type projector (a rear projector), and includes: a projection unit 11; a projection lens 12; a mirror 13; and a screen 14. Note that although the embodiment is explained assuming that the HDR-compliant display is the rear-projection-type projector 10, the HDR-compliant display may be a reflection-type projector, or other displays (display devices), such as a plasma display, a liquid crystal display, and an organic EL (Electroluminescent) display.

The projection unit 11 generates a projection light based on the display signal in order to project a video on the screen 14. For example, the projection unit 11 includes a light source and a spatial modulator. The light source is a lamp, an LED (Light Emitting Diode), etc. The spatial modulator is an LCOS (Liquid Crystal On Silicon) panel, a transmission-type liquid crystal panel, a DMD (Digital Mirror Device), or the like. The projection unit 11 modulates a light from the light source by the spatial modulator. The light modulated by the spatial modulator is then emitted as the projection light from the projection lens 12. The projection light from the projection lens 12 is reflected in a direction of the screen 14 by the mirror 13. The projection lens 12 has a plurality of lenses, and enlargedly projects the video from the projection unit 11 on the screen 14.

The processing device 40 is, for example, a personal computer (PC) etc., and includes: a CPU (Central Processing Unit); a memory; a graphic card; a keyboard; a mouse; an input-output port (input-output I/F), etc. The input-output port regarding video input-output is, for example, an HDMI (High Definition Multimedia Interface), a DisplayPort, a DVI (Digital Visual Interface), and an SDI (Serial Digital Interface). The processing device 40 stores a video file in a memory, a hard disk, etc. Alternatively, the processing device 40 may be a digital camera. In a case where the processing device 40 is the digital camera, the processing device 40 performs predetermined processing to a video acquired by an imaging element.

The interface unit 30 has an interface between the processing device 40 and the projector 10. That is to say, data is transmitted between the processing device 40 and the projector 10 through the interface unit 30. Specifically, the interface unit 30 includes: an output port of the processing device 40; an input port of the projector 10; an AV (Audio Visual) cable that connects the output port and the input port, etc.

The processing device 40 generates transmission data transmitted to the interface unit 30. Specifically, the processing device 40 stores the video file in the memory etc. The processing device 40 generates transmission data compatible with standards of an interface of the interface unit 30 based on the video file. The processing device 40 then outputs the transmission data to the projector 10 through the interface unit 30. That is to say, the interface unit 30 transmits to the projector 10 the transmission data generated in the processing device 40. The projector 10 generates a display signal based on the input transmission data. The projector 10 then displays a video based on the display signal.

Here, the number of bits (a bit width) transmitted by the interface unit 30 is limited by the graphic card of the processing device 40 or the interface of the interface unit 30. For example, only low-bit data of 8 bits (256 gradations) or 12 bits (4096 gradations) may be able to be transmitted by general-purpose interfaces, such as the HDMI (High Definition Multimedia Interface), the DisplayPort, the DVI (Digital Visual Interface), and the SDI (Serial Digital Interface). Meanwhile, an HDR video that can be displayed by the projector 10 is high-bit data of 16 bits or 32 bits. Therefore, in the embodiment, the processing device 40 generates transmission data including low-bit video data (display gradation data) compatible with the interface standards of the interface 30.

In the following explanation, the explanation will be performed assuming that data having the number of bits (the bit width) that can be transmitted by the interface unit 30 is set to be low-bit data (for example, 8 bits or 12 bits), and that data having the higher number of bits (the bit width) than the low-bit data is set to be high-bit data (for example, 16 bits or 32 bits). That is to say, in a case where the interface unit 30 can transmit 8-bit data, the 8-bit data is the low-bit data, and data larger than 8 bits is the high-bit data. In addition, in a case where the interface unit 30 can transmit 12-bit data, the 12-bit data is the low-bit data, and data larger than 12 bits is the high-bit data. The projector 10 displays a high-bit video, i.e., the HDR video. Consequently, the projector 10 can properly display a camera video captured with a wide dynamic range and a CG video created with an HDR.

Figure 2:
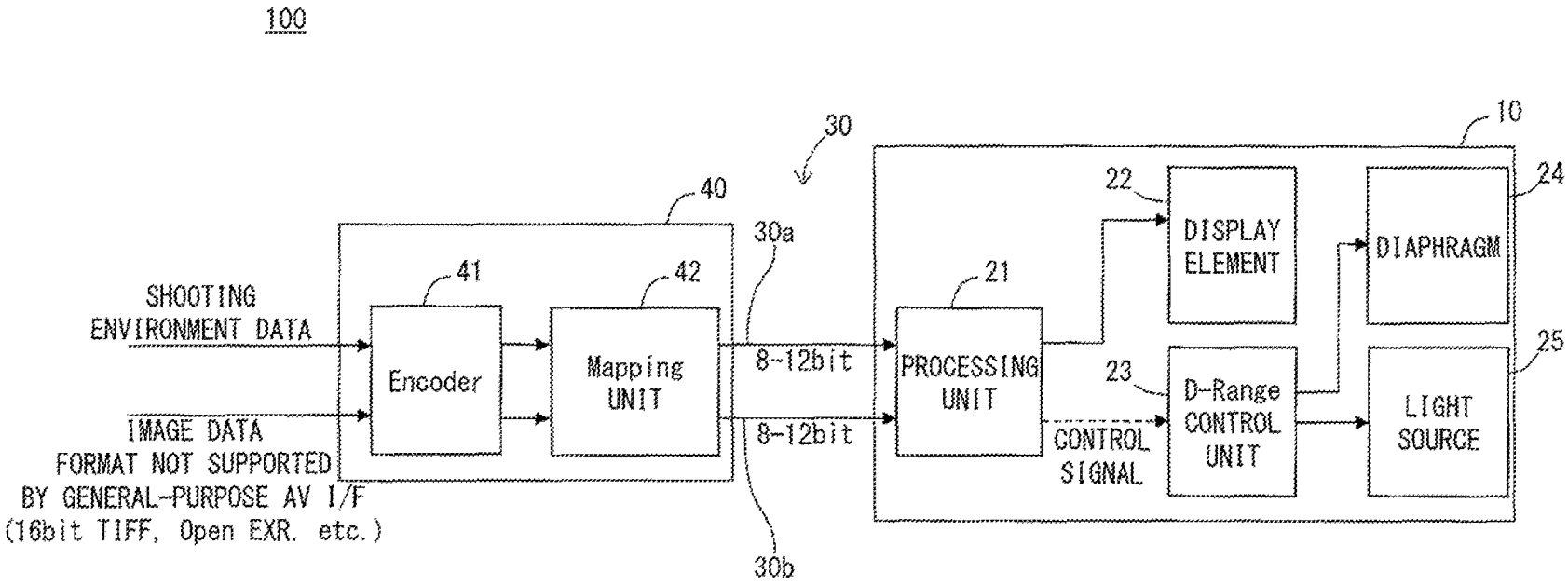
FIG. 2 is a block diagram schematically showing a configuration of the display system.

FIG. 2 shows a schematic block diagram of processing in the display system. The processing device 40 and the projector 10 are connected to each other through two interfaces 30*a* and 30*b*. The processing device 40 includes an encoder 41 and a mapping unit 42. For example, image data included in a video file, and shooting environment data are input to the processing device 40. Note that the processing device 40 may store the image data and the shooting environment data in the memory etc., and may read them from the memory.

The image data is recorded in a format of 16 bit TIFF, Open EXR, etc. The image data is stored in the memory etc. in a format not supported by a general-purpose AV interface. The image data is, for example, the high-bit data of 16 bits or 32 bits. The image data includes data having a 16-bit gradation or a 32-bit gradation for each pixel. For example, the data having the 16-bit gradation is changed to the data having the 8-bit gradation, whereby a gradation value is compressed into 1/256, and a gradation property gets worse. Accordingly, if the data is transmitted as it is through the general-purpose interface 30*a* or 30*b*, image quality deteriorates.

The shooting environment data is data indicating a shooting environment. For example, in a case where the image data is data acquired by the digital camera, the shooting environment data is metadata indicating a shutter speed, an F value, an ISO speed, etc. of the digital camera.

The encoder 41 encodes the shooting environment data and the image data to thereby generate transmission data. More specifically, the encoder 41 generates one video data based on the shooting environment data and the image data. High-bit gradation data is included in the video data. That is to say, the gradation data included in the video data is the high-bit data. Further, the encoder 41 generates the transmission data according to the standards of the interface unit 30 based on the high-bit video data. The transmission data is low-bit data that can be transmitted by the interface unit 30.

The mapping unit 42 performs mapping processing according to the interface of the interface unit 30. Note that the processing of the mapping unit 42 will be mentioned later. The transmission data is then transmitted through the interface unit 30.

In the embodiment, the interface unit 30 has the two interfaces 30*a* and 30*b*. The interfaces 30*a* and 30*b* are AV interfaces that can transmit videos and sounds, respectively. For example, the interface 30*a* is the HDMI, and the interface 30*b* is the DVI. As described above, it is possible to set the two interfaces 30*a* and 30*b* to have different standards. In addition, the interfaces 30*a* and 30*b* may just be any one of the HDMI, the DisplayPort, the DVI, the SDI, etc., respectively. As a matter of course, the interfaces 30*a* and 30*b* may be general-purpose interfaces other than the HDMI, the DisplayPort, the DVI, or the SDI. That is to say, the interfaces 30*a* and 30*b* are the general-purpose interfaces that transmit low-bit video data, respectively.

In addition, the interface 30*a* and the interface 30*b* may have the same standards. For example, in a case where the processing device 40 has two HDMI output terminals, one HDMI output terminal may serve as the interface 30*a*, and the other HDMI output terminal may serve as the interface 30*b*. In this case, of course, two HDMI input terminals are provided also at the projector 10. The interfaces 30*a* and 30*b* may have the same standards or different ones as long as they are physically two interfaces. In other words, the interface unit 30 has two AV cables to connect the projector 10 and the processing device 40.

The projector 10 includes: a processing unit 21; a display element 22; a D-Range control unit 23; a diaphragm (an aperture) 24; and a light source 25. The processing unit 21 includes a processor, a memory, etc., and performs predetermined processing to transmission data. The processing unit 21 generates a display signal and a control signal based on two transmission data transmitted through the interface unit 30.

The display signal generated by the processing unit 21 is output to the display element 22. The display element 22 has the spatial modulator etc. provided in the projection unit 11, and modulates a light based on the display signal. That is to say, the display element 22 includes a plurality of pixels, and drives each pixel based on the display signal. Hereby, the projector 10 displays a desired video.

Further, the control signal generated by the processing unit 21 is input to the D-Range control unit 23. The D-Range control unit 23 controls a dynamic range of the projector 10 based on the control signal. Specifically, the D-Range control unit 23 controls the diaphragm 24 and the light source 25. For example, the D-Range control unit 23 controls a size of an opening of the diaphragm 24 provided in the projection lens 12. The diaphragm 24 controls a luminance in a screen per frame of a moving image.

In addition, the D-Range control unit 23 controls an amount of light emission of the light source 25 provided in the projection unit 11. The light source 25 controls the luminance in the screen per frame of the moving image. Note that in a case where a liquid crystal display or the like is used as a display device instead of the projector 10, the D-Range control unit 23 may control an amount of light of the light source 25 in a local dimming manner. In this case, the plurality of light sources 25 that can be controlled independently are provided in the projection unit 11. Additionally, a part of a one-frame video is set to have a high luminance, and the other part thereof is set to have a low luminance. The D-Range control unit 23 controls the diaphragm 24 and the light source 25 based on the control signal, and thereby the video is displayed with a desired luminance. Consequently, the video can be displayed with higher image quality. Note that the D-Range control unit 23 may control only one of the diaphragm 24 and the light source 25.

Figure 3:
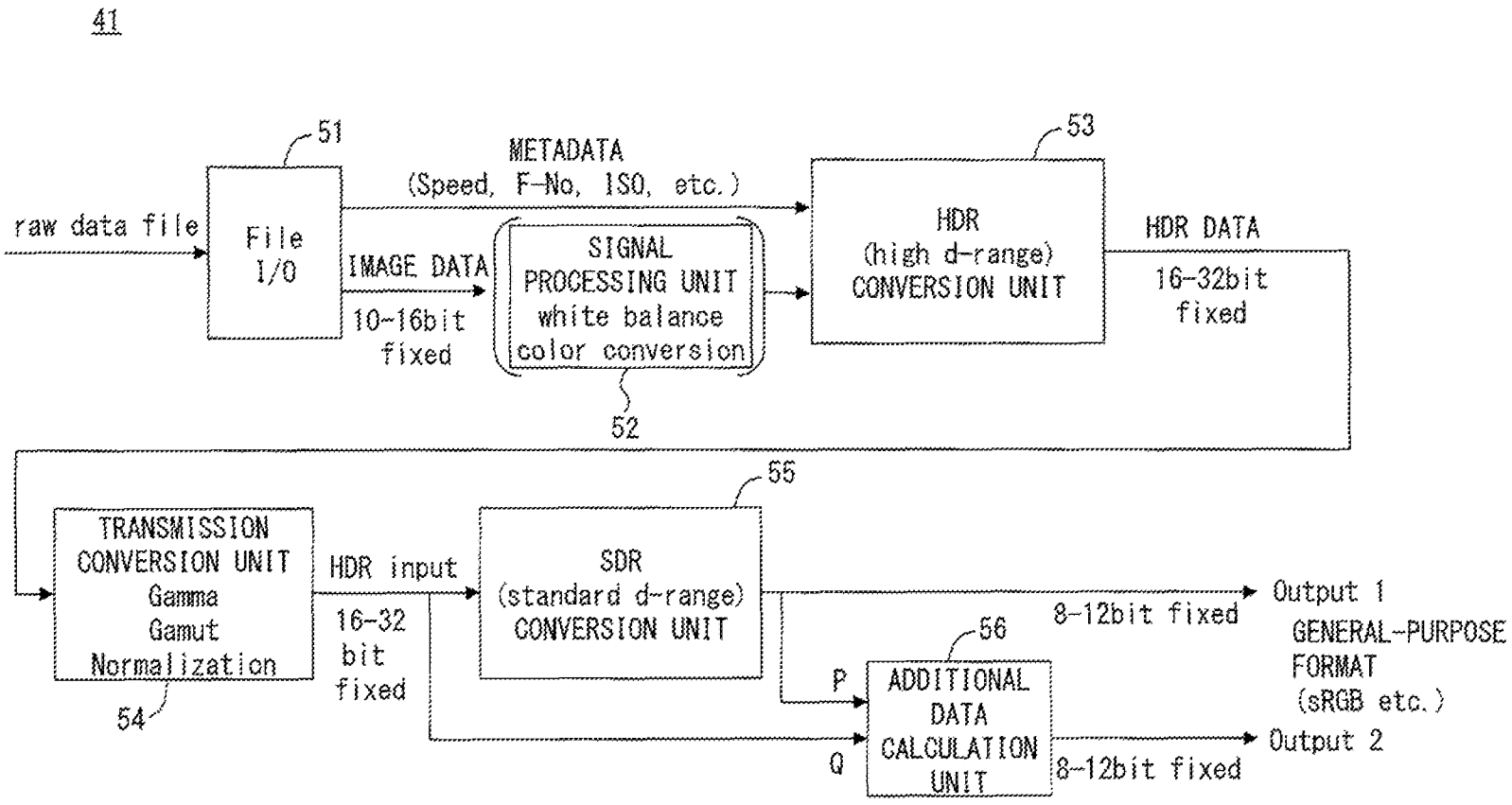
FIG. 3 is a block diagram showing a configuration of a decoder of a processing device.

Next, processing in the encoder 41 of the processing device 40 will be explained using FIG. 3. FIG. 3 is a block diagram showing the processing in the encoder 41. The encoder 41 includes: a file I/O 51; a signal processing unit 52; an HDR (High Dynamic Range) conversion unit 53; a transmission conversion unit 54; an SDR (Standard Dynamic Range) conversion unit 55; and an additional data calculation unit 56. Here, explanation will be performed assuming that a video file to be displayed is a RAW data file shot by a camera.

The file I/O 51 reads from the memory etc. the RAW data file shot by the camera. The file I/O extracts image data and metadata from the RAW data file. Note that the image data is 10 to 16-bit data of a fixed-point system (10 to 16 bit fixed). In a case where the image data is 16 bits, each pixel takes a value of 16 bits (0 to 65535). In addition, the image data is data in which gamma correction has not been made. The metadata is data indicating a shutter speed, an F value, and an ISO speed of the digital camera at the time of shooting. That is to say, the metadata corresponds to the shooting environment data of FIG. 2.

The image data extracted by the file I/O 51 is input to the signal processing unit 52. The signal processing unit 52 performs signal processing to the image data as needed. Specifically, the signal processing unit 52 performs white balance processing and color conversion processing. In the white balance processing, inputs of RGB are multiplied by predetermined gain values, respectively in order to have a color temperature of a certain target. That is to say, the signal processing unit 52 multiplies an input of R by a gain of R. Similarly, the signal processing unit 52 multiplies an input of G by a gain value of and multiplies an input of B by a gain value of B. Hereby, the white balance can be corrected. In color conversion, a numerical value set of RGB by matrix calculation of 3*3 is converted into another numerical value set of RGB.

The image data to which processing in the signal processing unit 52 has been performed is input to the HDR conversion unit 53. In addition, the metadata extracted from the RAW data file is input to the HDR conversion unit 53. The HDR conversion unit 53 generates an HDR video data based on the metadata and the image data. The HDR video data is 16 to 32-bit data of the fixed-point system (16 to 32 bit fixed). The HDR conversion unit 53 generates HDR video data corresponding to a dynamic range at the time of shooting by the digital camera.

For example, the HDR conversion unit 53 decides reference data between a brightness (cd/m$^2$) and a gradation value, from the metadata. The HDR conversion unit 53 then converts the data into an HDR signal based on the reference data. Since the reference data is set using a method on the basis of settings (the F value, the shutter speed, and the ISO) in the brightest scene, i.e., on the basis of conditions where the luminance is the highest as imaging conditions, in order to prescribe a maximum luminance value of after-mentioned HDR data. In addition, as long as a calibrated camera is used, the other method on the basis of imaging conditions under conditions of a prescribed brightness (luminance), etc. may be used.

Assume that the ISO speed of the input metadata is 200, the F value thereof is 2.8, and that the shutter speed thereof is 1/512. In addition, in the metadata serving as a criterion (criterion setting), assume that the ISO speed is 400, the F value is 4.0, and that the shutter speed is 1/64. Since an amount of light entering a sensor of the camera is 1/2 in the ISO speed, twice in the F value, and 1/8 in the shutter speed with respect to the criterion setting, a total amount of light is 1/8.

Assume that the image data included in the RAW data file is 12 bits. Additionally, assume that pixel data of R (red) is 4020 (/4095), pixel data of G (green) is 250 (/4095), and that pixel data of B (blue) is 1920 (/4095). The HDR conversion unit 53 extends the bit width to 16 bits (i.e., extends it 16 times larger), and multiplies it by 1/8 of a ratio of the amount of light.

Accordingly, the bit width totally becomes a double value. That is to say, the result is that R=8040 (/65535), G=500 (/65535), and B=3840 (/65535) in a 16-bit HDR video. By performing the processing as described above, lack of an input signal does not occur.

The HDR conversion unit 53 outputs the HDR video data to the transmission conversion unit 54. The transmission conversion unit 54 performs transmission conversion processing to the HDR video data. For example, the transmission conversion unit 54 performs Gamma processing, Gamut processing, and normalization processing.

In the Gamma processing, for example, gamma correction is made by a one-dimensional LUT (Look Up Table). In the Gamut processing, color gamut conversion is performed by a three-dimensional LUT. In the normalization processing, processing to match the number of input bits with the number of output bits is performed. For example, in a case where an input is 16 bits, and where an output is 12 bits, the input is multiplied by 1/16, and then is output. Alternatively, the input is clipped at 4095, which is a maximum value of 12 bits, and then is output.

The HDR video data to which transmission conversion has been performed by the transmission conversion unit 54 is input to the SDR conversion unit 55. The SDR conversion unit 55 performs SDR conversion of the video data. That is to say, the SDR conversion unit 55 converts high-bit HDR video data into low-bit SDR video data.

Figure 4:
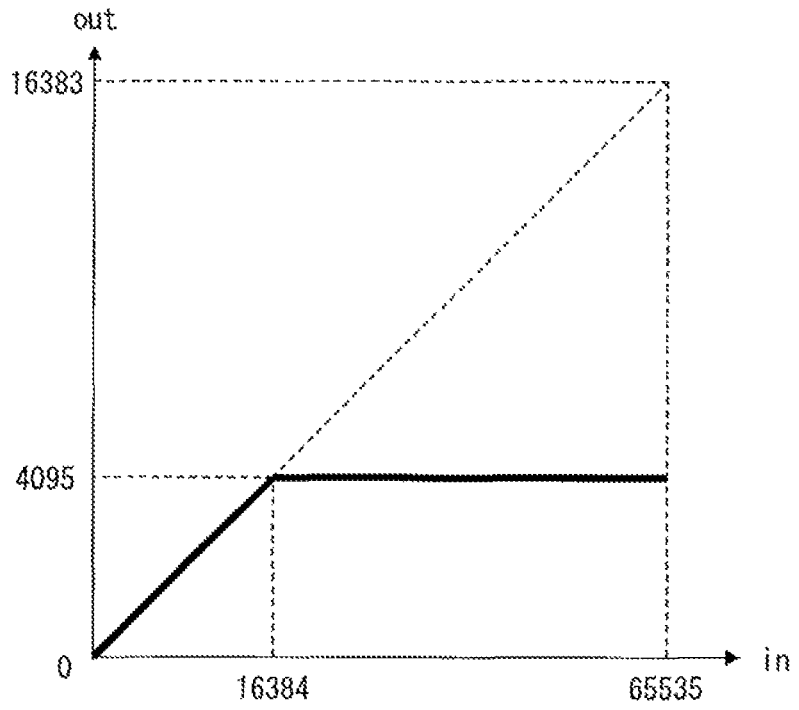
FIG. 4 is a graph for explaining decoding processing from HDR video data to SDR video data.

In the embodiment, there will be explained an example where 16-bit HDR video data is output as 12-bit SDR video data. The SDR conversion unit 55 compresses a 16-bit input into a 14-bit one, clips it at 12 bits, and then outputs it. FIG. 4 is a graph for explaining processing in the SDR conversion unit 55. In FIG. 4, a horizontal axis is an input value, and a vertical axis is an output value. In a case where the HDR video data ranges from 0 to 16384, the SDR video data is an integer portion of a 1/4 value of the HDR video data. In a case where the HDR video data ranges from 16384 to 65535, the SDR video data is clipped to be 4095. By performing the processing as described above, the 16-bit (0 to 65535) HDR video data is converted into the 12-bit (0 to 4095) SDR video data. The SDR conversion unit 55 sets the SDR video data as an output1, and outputs it to the mapping unit 42. The SDR video data output1 is a general-purpose format of sRGB etc. Further, the SDR conversion unit 55 outputs SDR video data P to the additional data calculation unit 56.

Note that although FIG. 4 has been explained assuming that the SDR conversion unit 55 outputs the 12-bit SDR video data, the SDR conversion unit 55 may output 8-bit SDR video data. That is to say, an output of the SDR conversion unit 55 can be set according to the number of bits of transmission data that can be transmitted by the interface unit 30. For example, in a case where 8-bit transmission data can be transmitted by the interface unit 30, the SDR conversion unit 55 generates the 8-bit SDR video data. In this case, an SDR video of the predetermined number of bits can be generated by appropriately changing a compression ratio and a clipping value.

Let us return to the explanation of FIG. 3. The SDR video data P is input to the additional data calculation unit 56. Further, HDR video data Q from the transmission conversion unit 54 is input to the additional data calculation unit 56. The additional data calculation unit 56 generates additional data based on the HDR video data Q and the SDR video data P. The additional data is data added to the SDR video data.

As described above, in the case where the interface unit 30 can transmit the 12-bit transmission data, the SDR conversion unit 55 converts the 16-bit HDR video data into the 12-bit SDR video data. The additional data calculation unit 56 generates 12-bit additional data.

As shown in the following expression, the additional data calculation unit 56 generates additional data output2 based on the SDR video data P and the HDR video data Q.

```
IF (P<4095)

Output2=Q−P*4

ELSE

Output2=((float)Q/16384.0)*1024.0 (only an integer
    portion is output)
```

In a case where P is smaller than 4095, the output2 is an integer value (a difference value) of 0 to 3. In a case where P is equal to or larger than 4095, the output2 is an integer value (a gain value) of 1024 to 4095. As described above, the additional data calculation unit 56 generates the 12-bit additional data. The additional data calculation unit 56 sets the additional data as the output2, and outputs it to the mapping unit 42.

Note that a value (4095) in a conditional branch IF is a maximum value of a bit width (12 bits) of the output2. In a case of P<4095, a value obtained by multiplying P by the compression ratio (it is 4 here) is subtracted from Q, and thereby the output2 can be calculated. The output1 (the SDR video data) is 12 bits, and the HDR video data is 16 bits. The compression ratio is set to be 4 in order to quadruple a range difference between the HDR video data and the SDR video data. That is to say, 12 bits+2 bits (4 times)=14 bits, and a 16-bit input is compressed by 2 bits into a 14-bit output. As described above, since 16 bits (65535) are compressed into 14 bits (16383), the compression ratio is 4 (=65535/16383) in the embodiment.

Note that 1024 in ELSE is a gain coefficient calculated from the compression ratio by clipping, and is a value in which a gain ratio is 1.0. In the embodiment, the SRD video data is compressed from 14 bits to 12 bits by the clipping, the output1 and the output2 are 12 bits, and thus it is established that 4096/(16383/4095)=1024. That is to say, 1024 in ELSE is the value obtained by dividing the maximum value (4095) of the bit widths of the output1 and the output2 by the compression ratio (16383/4095) by the clipping. As a matter of course, the value in the above-described expression can be appropriately changed according to the number of bits of the HDR video data and the SDR video data. For example, in a case of generating the SDR video data based on the graph like FIG. 4, values of the expression can be appropriately changed according to values in the graph.

Figure 5:
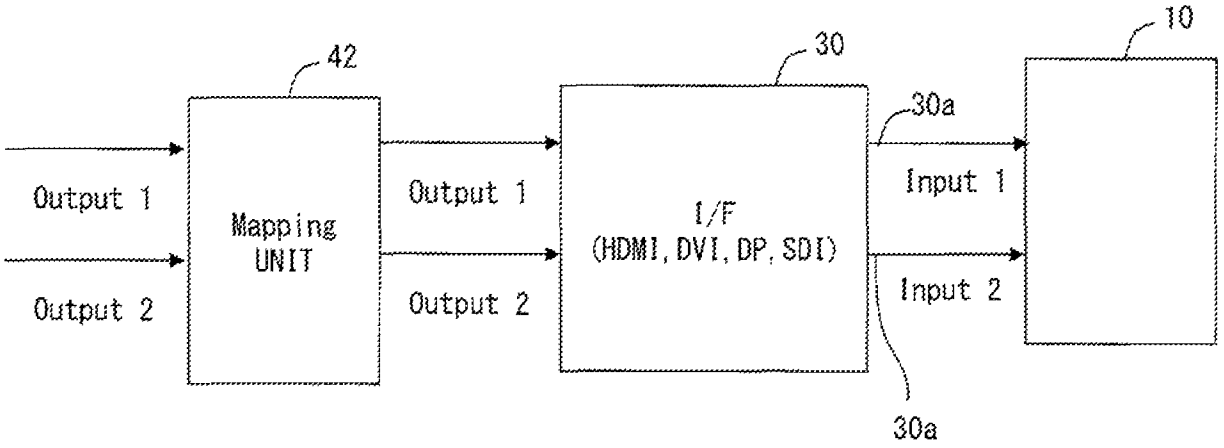
FIG. 5 is a diagram showing processing in a mapping unit and an interface unit.

Next, processing of the mapping unit 42 will be explained using FIG. 5. FIG. 5 is a block diagram schematically showing processing in the mapping unit 42 and the interface unit 30. The mapping unit 42 maps the SDR video data output1 and the additional data output2 according to the interface unit 30. As described above, the SDR video data output1 and the additional data output2 are input to the mapping unit 42. In addition, the two interfaces 30*a* and 30*b* are provided in the interface unit 30.

Accordingly, in FIG. 5, the SDR video data output1 and the additional data output2 are included in transmission data as they are. The SDR video data output1 is transmitted through the interface 30*a*, and the additional data output2 is transmitted through the interface 30*b*. The interface unit 30 parallely transmits the SDR video data output1 and the additional data output2. That is to say, the SDR video data output1 and the additional data output2 are simultaneously transmitted.

As described above, two transmission data input1 and input2 transmitted through the two interfaces 30*a* and 30*b* include the SDR video data output1 and the additional data output2, respectively. That is to say, the first transmission data input1 transmitted by the interface 30*a* includes the SDR video data output1, and the second transmission data input2 transmitted by the interface 30*b* includes the additional data output2. In addition, the two transmission data include information on frames and pixel addresses. The two transmission data input1 and input2 transmitted through the interface unit 30 are input to the projector 10.

Figure 6:
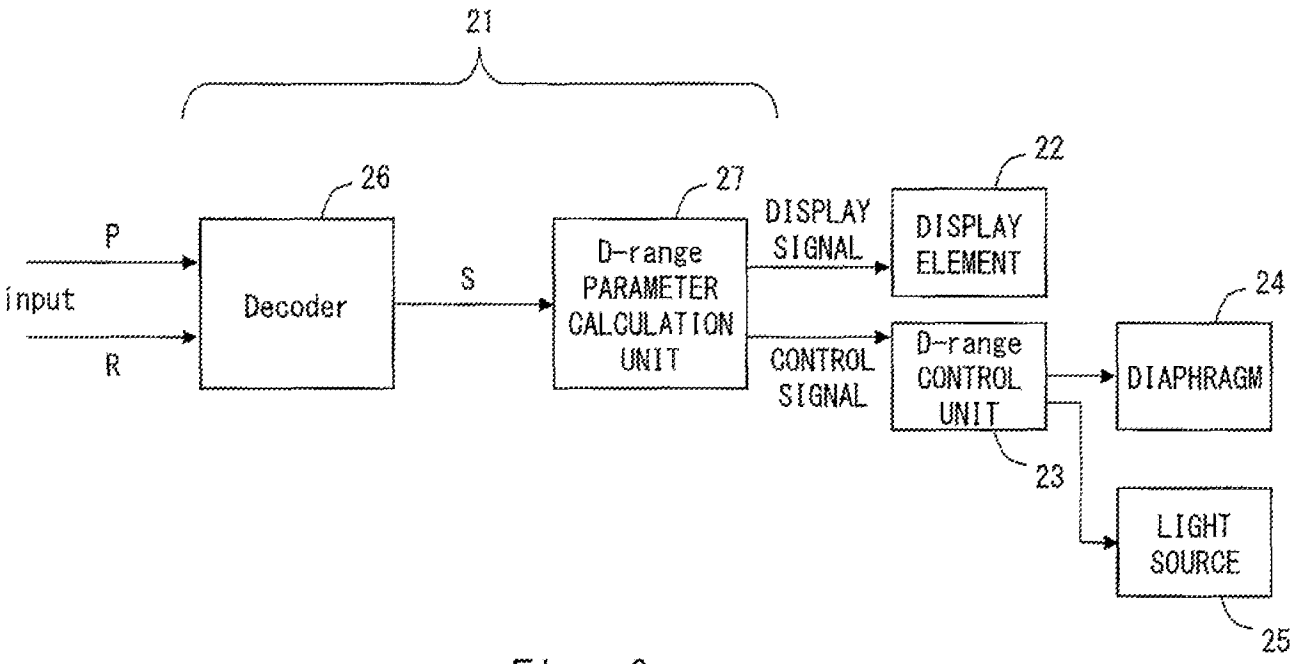
FIG. 6 is a block diagram showing a configuration of a display device.

Processing in the projector 10 will be explained using FIG. 6. FIG. 6 is a block diagram for explaining the processing of the projector 10. As shown in FIG. 6, the projector 10 includes: the processing unit 21; the display element 22; the D-Range control unit 23; the diaphragm 24; and the light source 25. The processing unit 21 includes a decoder 26 and a parameter calculation unit 27.

The transmission data input to the projector 10 through the interface unit 30 includes the SDR video data P and additional data R. As described above, the first transmission data includes the SDR video data P, and the second transmission data includes the additional data R. The decoder 26 decodes the SDR video data P and the additional data R to thereby generate HDR video data S. The decoder 26 generates the HDR video data S by the following expression.

```
IF (R<1024)

S=R+P*4

ELSE

S=4095.0*((float) R/1024.0) (only an integer portion
    is output)
```

In a case where R is smaller than 1024, P is also smaller than 4095, and thus the HDR video data S has a value of 0 to 16383. In a case where R is equal to or larger than 1024, P is also not equal to or larger than 4095, and thus the HDR video data S has a value of 16384 to 65535. As described above, the HDR video data S becomes 16-bit data of 0 to 65536. Consequently, the HDR video data S equal to the HDR video data Q in the processing device 40 is restored.

Figure 7:
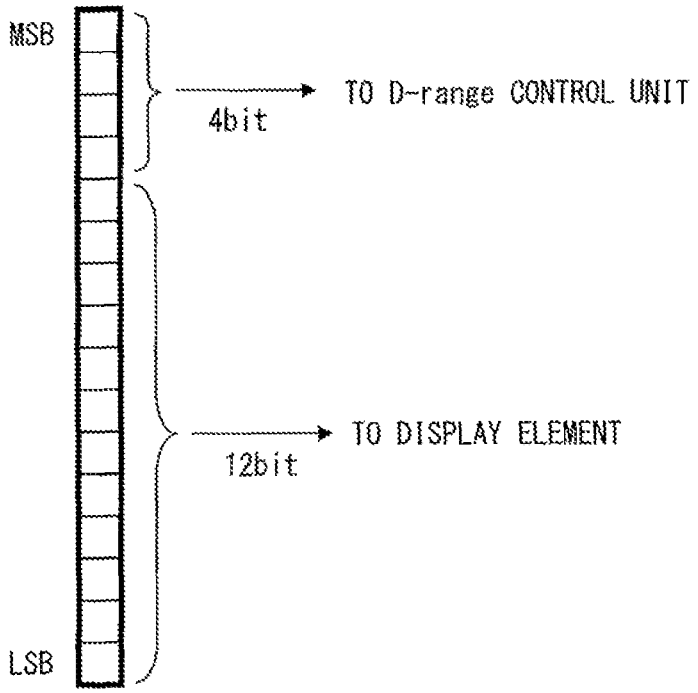
FIG. 7 is a diagram for explaining processing in a parameter calculation unit.

Note that since the information on the frames and the pixel addresses is added to the first transmission data and the second transmission data, the decoder 26 can synthesize the SDR video data P and the additional data R in the same pixel address in the same frame to thereby generate the HDR video data S. The decoder 26 decodes the SDR video data P and the additional data R to thereby generate the HDR video data S. Here, the HDR video data S is the 16-bit data. The parameter calculation unit 27 generates a display signal and a control signal based on the HDR video data. Processing in the parameter calculation unit 27 will be explained using FIG. 7.

The parameter calculation unit 27 divides the HDR video data into high-order-bit-side data and low-order-bit-side data. Specifically, the parameter calculation unit 27 sets high-order 4 bits of the 16-bit HDR video data as a D-range parameter. The parameter calculation unit 27 then generates the control signal based on the D-range parameter. Further, the parameter calculation unit 27 generates the display signal based on low-order 12 bits of the HDR video data. That is to say, the parameter calculation unit 27 divides the 16-bit HDR video data into MSB (Most Significant bit)-side 4 bits and LSB (Least Significant bit)-side 12 bits. The parameter calculation unit 27 then generates the control signal based on the MSB-side 4 bits, and generates the display signal based on the LSB-side 12 bits.

The display signal generated by the parameter calculation unit 27 is input to the display element 22. The display element 22 displays a video based on the display signal. The display element 22 includes a plurality of pixels arranged in a matrix form, and each pixel is driven based on the display signal. Hereby, each pixel of RGB can perform 12-bit gradation display, and a desired video can be displayed.

The control signal is input to the D-Range control unit 23. The D-Range control unit 23 controls the diaphragm 24 and the light source 25 as described above. Outputs of the diaphragm 24 and the light source 25 are controlled based on the control signal. Widening the opening of the diaphragm 24 makes a luminance high, and narrowing it makes the luminance low. In addition, increasing the output of the light source 25 makes the luminance high, and decreasing it makes the luminance low. As described above, the diaphragm 24 and the light source 25 serve as luminance adjustment units that adjust a luminance of the video to be displayed by the control signal. As a matter of course, the luminance may be adjusted by only either one of the diaphragm 24 and the light source 25. The control signal, for example, controls the diaphragm 24 and the light source 25 for each frame. Since the control signal is 4 bits, the D-Range control unit 23 can adjust a luminance of the frame in sixteen stages.

Note that although the parameter calculation unit 27 separates the HDR video data into the high-order 4 bits and the low-order 12 bits in the above explanation, a bit position at which the parameter calculation unit 27 divides the HDR video data may just be set according to performance of the display element 22, the diaphragm 24, and the light source 25. For example, if each pixel of the display element 22 displays the data with an 8-bit gradation, and the diaphragm 24 and the light source 25 can adjust the luminance with 8 bits, the parameter calculation unit 27 may just divide the HDR video data into high-order 8 bits and low-order 8 bits.

Further, if each pixel of the display element 22 can perform gradation display by the same number of bits as the HDR video data, the D-Range control unit 23 need not divide the HDR video data. That is to say, if the display element 22 can perform 16-bit gradation display, the processing unit 21 generates a 16-bit display signal based on the 16-bit HDR video data. In this case, the D-Range control unit 23 etc. become unnecessary.

As described above, the processing device 40 generates from the HDR video data the SDR video data and the additional data added to the SDR video data. The interface 30*a* transmits the first transmission data including the SDR video data, and the interface 30*b* transmits the second transmission data including the additional data. Accordingly, even in a case where the interface 30*a* and the interface 30*b* are compliant only with an SDR video data format, respectively, the HDR video can be displayed on the projector 10 side. Consequently, the HDR video can be displayed using the general-purpose interface. Hereby, versatility can be enhanced.

Further, the projector 10 includes the D-Range control unit 23 that controls a dynamic range based on the control signal. The control signal is generated according to the SDR video data and the additional data. Specifically, the control signal is generated by the high-order-bit-side data of the HDR video data generated by the decoder 26. Consequently, the D-Range control unit 23 can easily adjust a luminance of a display video. Consequently, the dynamic range can be adjusted appropriately.

<General-Purpose Display>

Figure 8:
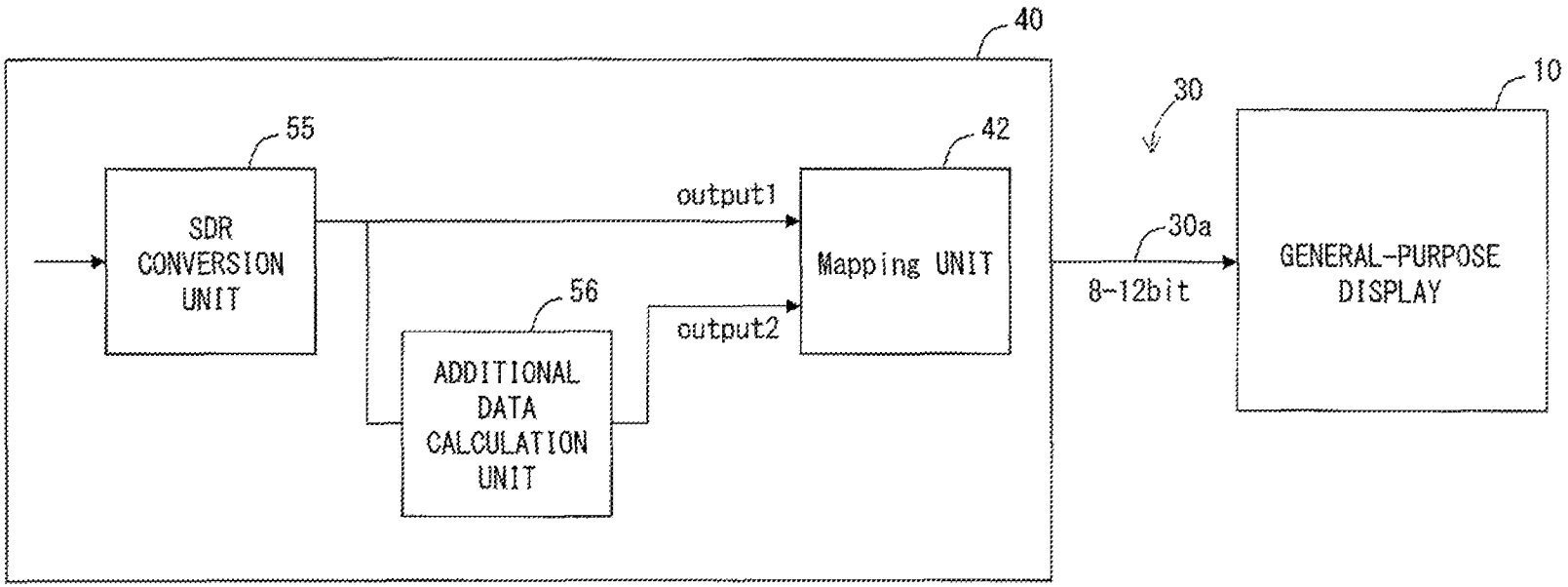
FIG. 8 is a diagram showing processing in the mapping unit and the interface unit in a case of using an SDR display device.

Next, using FIG. 8, there will be explained an example where the projector 10 is a non-HDR-compliant general-purpose display. FIG. 8 is a block diagram showing a configuration of a main portion of a display system. Note that FIG. 8 is illustrated, with configurations similar to FIGS. 2 and 3, etc. being omitted.

In FIG. 8, the projector 10 shown in FIGS. 1 and 2 is the general-purpose display that cannot display an HDR video. That is to say, the projector 10 cannot display a video of the higher number of bits (multiple gradations) than the SDR video data. In this case, as shown in FIG. 8, transmission data including the SDR video data may be transmitted by the one interface 30*a* provided in the interface unit 30.

Specifically, as shown in FIG. 8, the SDR video data output1 is input to the mapping unit 42 from the SDR conversion unit 55, and the additional data output2 is input to the mapping unit 42 from the additional data calculation unit 56. This is similar to FIGS. 4 and 6. The mapping unit 42 outputs to the interface 30*a* only the first transmission data corresponding to the SDR video data output1. That is to say, the interface unit 30 does not transmit to the projector 10 the second transmission data corresponding to the additional data output2. The SDR video data output1 is low-bit video data that can independently display an SDR video. For example, the SDR video data output1 has an sRGB format.

The interface 30*a* is a general-purpose interface, such as the HDMI, as described above. Consequently, the interface 30*a* can transmit the SDR video data. Additionally, the projector 10 generates a display signal from the SDR video data, and displays an SDR video. That is to say, the projector 10 displays a low-bit video according to the standards of the interface 30*a*. Even in a case of absence of additional data, the projector 10 displays the SDR video based on the SDR video data output1.

As described above, even in the case where the projector 10 is the general-purpose display compliant only with the SDR video, the interface 30*a*, which is the general-purpose I/F, transmits the SDR video data output1. Consequently, versatility can be enhanced. That is to say, the processing device 40 generates the SDR video data and the additional data added thereto regardless of the projector 10 being compliant or non-compliant with the HDR. Additionally, the mapping unit 42 performs mapping so that appropriate transmission data can be transmitted according to the configuration of the interface unit 30.

In the case of the HDR-compliant projector 10, the interface unit 30 transmits transmission data including the SDR video data and the additional data. The projector 10 generates HDR video data based on the SDR video data and the additional data. Hereby, the projector 10 can display an HDR video. Meanwhile, in the case of the non-HDR-compliant projector 10, the interface unit 30 transmits to the projector 10 transmission data including the SDR video data without transmitting the additional data. The projector 10 generates a display signal based on the SDR video data. Encoding processing on the processing device 40 side can be performed in common. Since processing need not be changed according to the configuration of the interface unit 30, versatility can be enhanced. That is to say, the processing device 40 can be connected to both the HDR display and the general-purpose display.

In the above-described example, the SDR video data has a value clipped at 4095. That is to say, in a case where the SDR conversion unit 55 generates the SDR video data from the HDR video data, the SDR conversion unit 55 compresses a gradation value of the HDR video data by the predetermined number of bits, and converts the compressed value into a value obtained by clipping the compressed value at a value according to the number of bits of the interface 30*a*. For example, as shown in FIG. 4, in a case where the gradation value of the HDR video data ranges from 16384 to 65535, a gradation value of the SDR video data is 4095. In a case where the gradation value of the SDR video data is 4095, white display is performed in the projector 10. By performing the processing as described above, the SDR video can be displayed in an appropriate range.

<CG Data>

Figure 9:
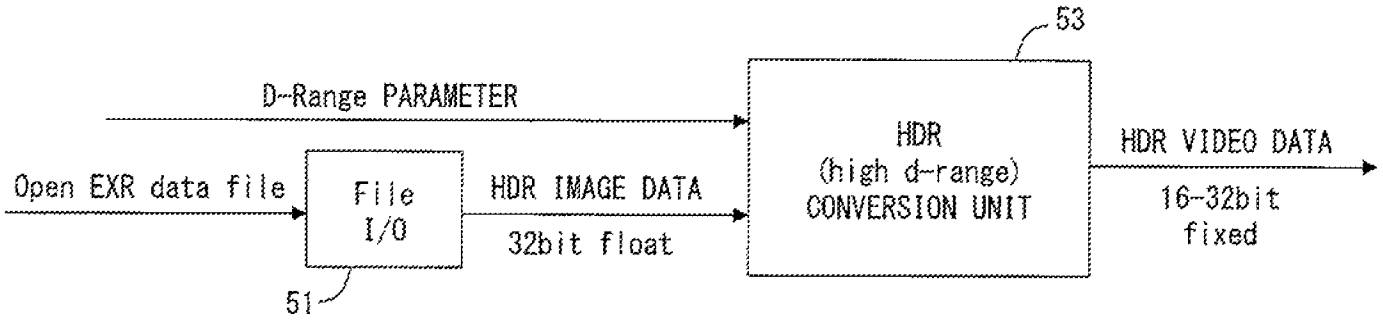
FIG. 9 is a diagram for explaining processing in a case of using an open EXR data file as a video file.

Using FIG. 9, there will be explained a case where a video file processed by the processing device 40 is a CG file. FIG. 9 shows an example where the video file is an open EXR data file. FIG. 9 is a block diagram showing a configuration of a main portion of the processing device 40. FIG. 9 is the block diagram showing a part of the encoder 41. Note that since configurations and processing of the HDR conversion unit 53 and subsequent thereto are similar to FIG. 3 etc., explanation thereof is omitted.

The file I/O 51 reads the open EXR data file, and extracts image data of a 32-bit floating point (a float). The file I/O 51 then outputs the image data to the HDR conversion unit 53. In addition, a D-range parameter indicating an absolute luminance is input to the HDR conversion unit 53 instead of the metadata of FIG. 3.

In a case of CG data, a dynamic range of video data is infinite (actually, in a range that can be represented by the 32-bit floating point). The D-range parameter is a parameter for making a dynamic range into data in a certain dynamic range.

The HDR conversion unit 53 generates HDR video data from the D-range parameter and the image data of the 32-bit floating point (a 32 bit float). The HDR video data is 16 to 32-bit data of a fixed point similarly to FIG. 3. As described above, similar processing can be performed also to the CG data, such as the open EXR data file. Consequently, versatility can be improved.

Figure 10:
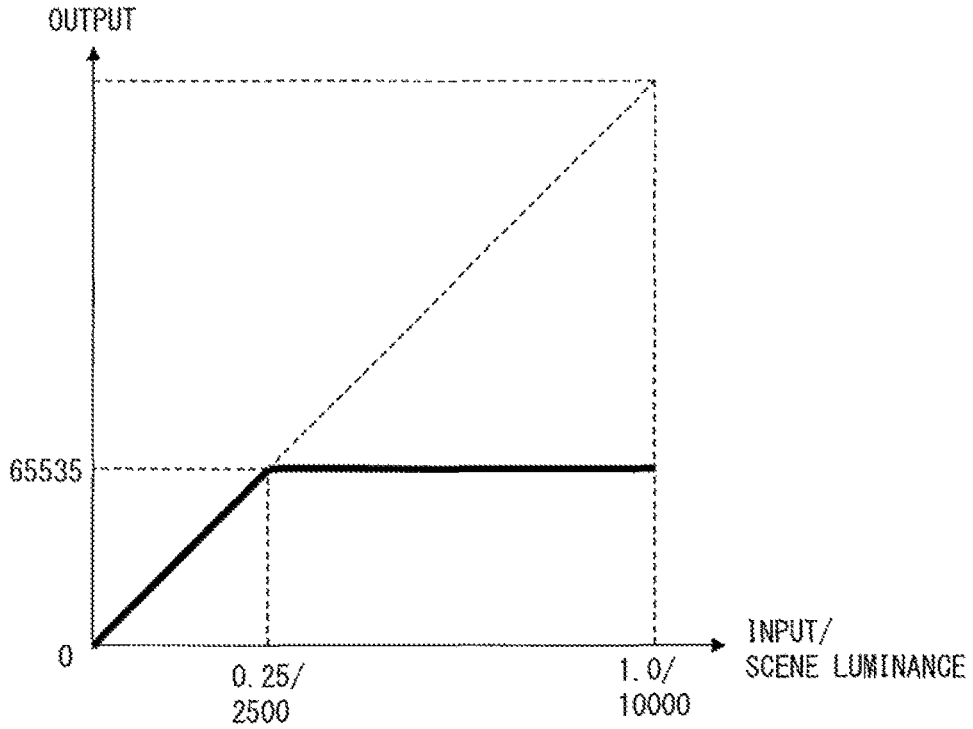
FIG. 10 is a graph showing one example of HDR conversion processing in a case of using CG data.

With reference to FIG. 10, there will be explained processing for the HDR conversion unit 53 to generate the HDR video data using the D-range parameter. FIG. 10 is a graph for explaining the processing in the HDR conversion unit 53 in a case of using CG data. In the CG data, an absolute luminance can be represented using the D-range parameter. Assume that as the D-range parameter, a maximum luminance of a scene is set to be 10000 cd/m$^2$ (1.0/32 bit float, range 0.0 to 1.0). In addition, assume that a maximum luminance of the projector 10 is 2500 cd/m$^2$ (65535/16 bit).

FIG. 10 shows processing to perform matching by the absolute luminance. That is to say, since the maximum luminance of the projector 10 is 2500 cd/m$^2$, an input and an output (the HDR video data) are linearly changed while the input ranges 0 to 0.25 (=2500 cd/m$^2$). For example, when the input is 0.25 (2500 cd/m$^2$), an output gradation value of the HDR video data is 65535. Additionally, when the input becomes larger than 0.25, the gradation value of the HDR video data is clipped at 65535. That is to say, in a case where the input is larger than 0.25 and not more than 1.0, the gradation value of the HDR video data becomes constant at 65535. As described above, in FIG. 10, the input not less than a luminance that can be output by the projector 10 is clipped.

Figure 11:
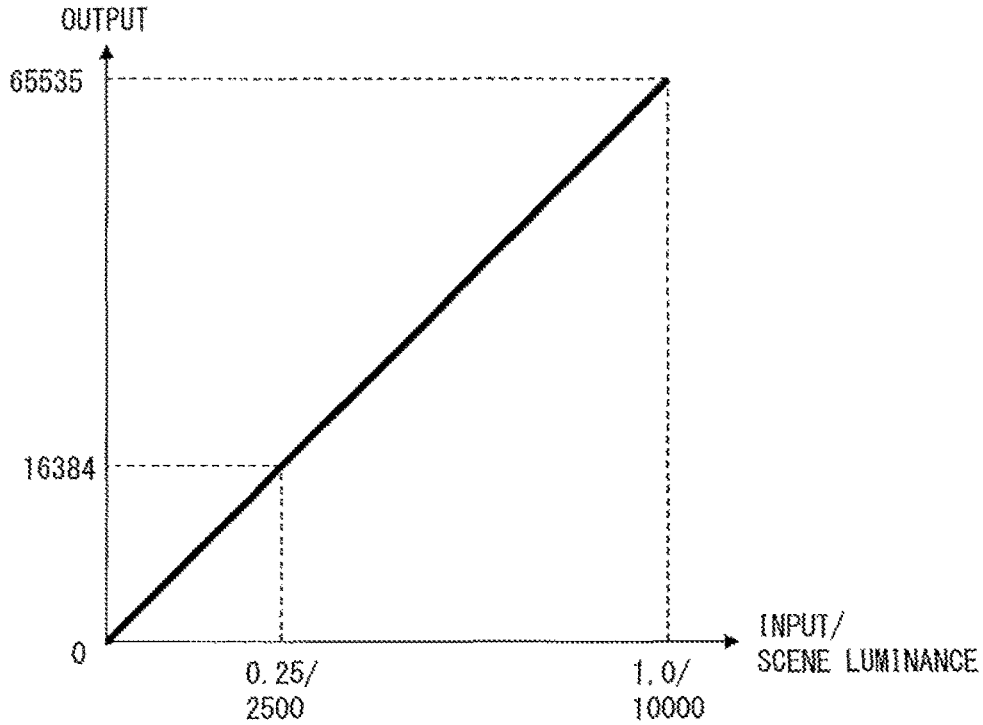
FIG. 11 is a graph showing an other one example of HDR conversion processing in the case of using CG data.

With reference to FIG. 11, there will be explained another processing for the HDR conversion unit 53 to generate the HDR video data. In FIG. 11, the input and the output are linearly changed. Assume that as the D-range parameter, the maximum luminance of the scene is set to be 10000 cd/m$^2$ (1.0/32 bit float, range 0.0 to 1.0). In addition, assume that a maximum luminance of the projector 10 is 2500 cd/m$^2$ (65535/16 bit). Accordingly, a luminance range is compressed so that ¼ of the input will be the output. For example, when the input is 0.25 (2500 cd/m$^2$), the output gradation value of the HDR video data is 16384. When the input is 1.0 (10000 cd/m$^2$), the output gradation value of the HDR video data is 65535 (a maximum value). As described above, the luminance range is compressed by a ratio between the maximum luminance of the D-range parameter and the maximum luminance of the projector 10.

Figure 12:
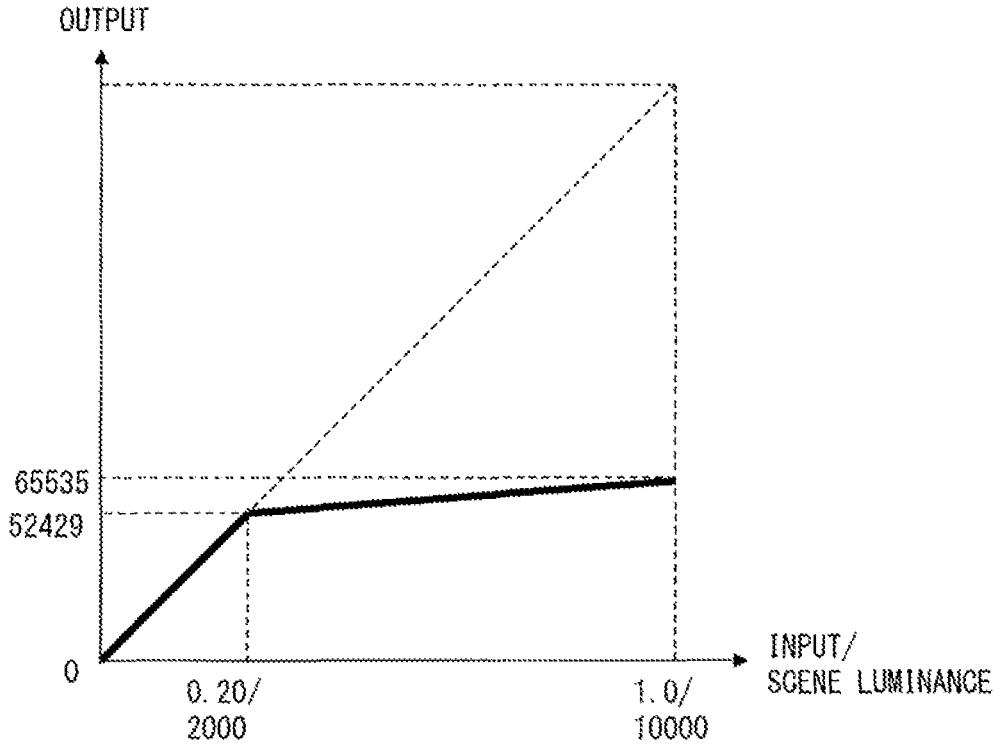
FIG. 12 is a graph showing an other one example of HDR conversion processing in the case of using CG data.

With reference to FIG. 12, there will be explained another processing for the HDR conversion unit 53 to generate the HDR video data. In FIG. 12, processing is performed in which the processing in FIG. 10, and the processing in FIG. 11 have been combined with each other. Specifically, matching of the absolute luminance is performed until 2000 cd/m$^2$, which is a prescribed value, as shown in FIG. 10. The luminance range is compressed in the luminance more than 2000 cd/m$^2$. Accordingly, the HDR video data can be generated by two straight lines having different slopes as shown in FIG. 12. Alternatively, it also becomes possible to generate the HDR video data by a non-linear function of the compressed luminance range.

Since the prescribed value is set to be 2000 cd/m$^2$, the input and the output (the HDR video data) are linearly changed in a range where the input is 0 to 0.20 (=2000 cd/m$^2$). For example, when the input is 0.20 (2000 cd/m$^2$), the output gradation value of the HDR video data is 52429. A relation between the input and the output coincides with that of FIG. 10 in the range where the input is 0 to 0.20 (=2000 cd/m$^2$).

Additionally, when the input becomes larger than 0.20, the luminance range is compressed, and thus the output can be determined linearly or non-linearly. Accordingly, when the input is 1.0 (10000 cd/m$^2$), an output gradation value of the HDR video data is 65535. As described above, the HDR video data is generated from the CG data having the D-range parameter by the processing shown in FIGS. 10 to 12. As a matter of course, the HDR conversion unit 53 may generate the HDR video data by the other processing.

<Three-Dimensional Image Format>

Figure 13:
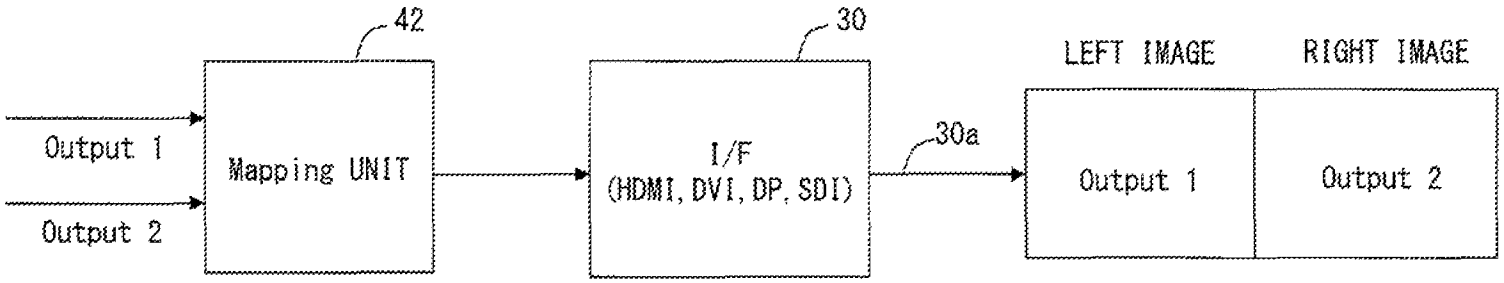
FIG. 13 is a diagram explaining processing in a case of mapping to a 3D image format.

Next, using FIG. 13, there will be explained a case where the interface unit 30 can transmit a three-dimensional (3D) image format. FIG. 13 is a diagram showing the interface unit 30 that can transmit a 3D image, and processing in the mapping unit 42. Note that since configurations and processing other than the interface unit 30 and the mapping unit 42 overlap with the above explanation, explanation thereof is omitted.

The interface 30*a* of the interface unit 30 can transmit the 3D image format. Here, the 3D image format is a side-by-side format including a left image and a right image as shown in FIG. 13. That is to say, the 3D image is generated by synthesizing the left image and the right image. The interface unit 30 transmits a 3D image of the side-by-side format. The 3D image is an SDR image of the lower number of bits than an HDR image.

For example, a resolution of the 3D image is the same as that of the HDR video. In this case, the left image and the right image also have the same resolutions as the HDR image. The mapping unit 42 assigns the SDR video data output1 to one of the left image and the right image, and assigns the additional data output2 to the other thereof. In FIG. 13, the mapping unit 42 assigns the SDR video data output1 to the left image, and assigns the additional data output2 to the right image. In this case, the mapping unit 42 can be used as a 3D encoder.

The interface unit 30 transmits as one transmission data the SDR video data output1 assigned to the left image and the additional data output2 assigned to the right image. Accordingly, the SDR video data output1 and the additional data output2 are simultaneously transmitted.

For example, a pixel address of the left image corresponding to a pixel address (x, y) of the 3D image is set as $(x_L, y_L)$, and a pixel address of the right image corresponding thereto is set as $(x_R, y_R)$. The SDR video data output1 of the pixel address (x, y) in the HDR image is set as data of $(x_L, y_L)$, and the additional data output2 is set as data of $(X_R, Y_R)$. Additionally, the one interface 30*a* that can transmit the left image and the right image transmits the HDR video data output1 and the additional data output2. The projector 10 generates the HDR video data of the pixel address (x, y) using the HDR video data assigned to the pixel address $(x_L, y_L)$ in the 3D image, and the additional data assigned to the pixel address $(x_R, y_R)$.

A processing unit of the projector 10 generates HDR video data of the pixel address using the same pixel address of the left image and the right image. If the display system 100 having the one interface 30*a* is employed, the HDR video can be displayed. That is to say, if there are provided the one or more interfaces 30*a* that can display the 3D image, the projector 10 can display the HDR video. Consequently, versatility can be more enhanced.

<High-Resolution Image Format>

Figure 14:
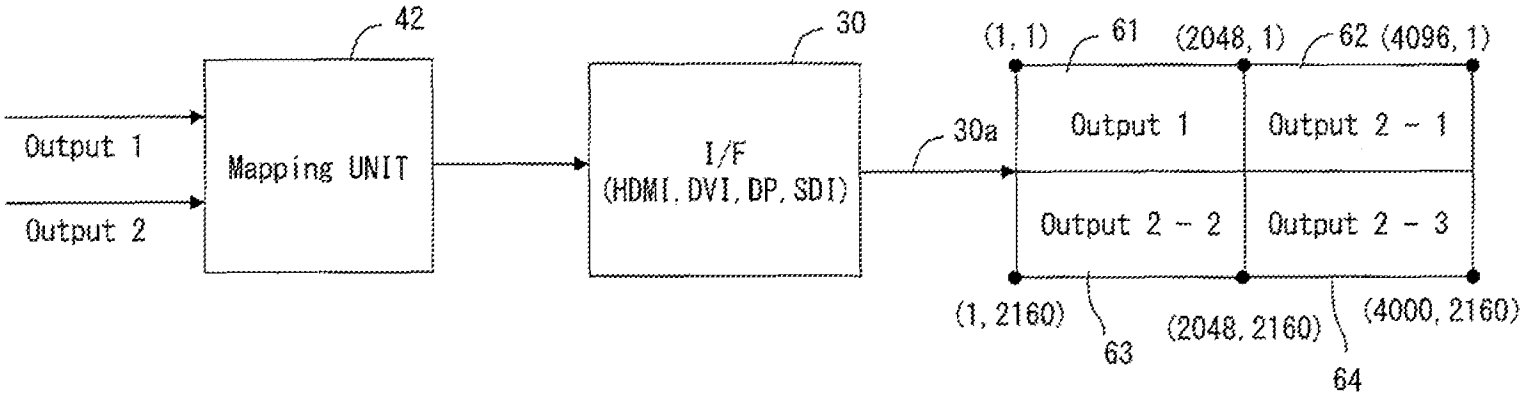
FIG. 14 is a diagram explaining processing in a case of mapping to a high-resolution image format.

FIG. 14 is a diagram for explaining processing in a case of including the interface unit 30 that can transmit a high-resolution image format. FIG. 14 is the diagram showing the interface unit 30 that can transmit the high-resolution image, and processing in the mapping unit 42. Note that since configurations and processing other than the interface unit 30 and the mapping unit 42 overlap with the above explanation, explanation thereof is omitted.

In FIG. 14, explanation will be performed assuming that the high-resolution image has a 4K resolution (4096 in width by 2160 in height), and a resolution of the HDR video is 2K (2048 in width by 1080 in height). A pixel address of a 4K image falls within a range where X=1 to 4096 and Y=1 to 2160. A resolution of the projector 10 is 2K. A pixel address of a 2K image falls within a range where X=1 to 2048 and Y=1 to 1080. The interface 30*a* of the interface unit 30 can transmit an image having the 4K resolution. That is to say, the interface 30*a* can transmit transmission data of a higher-resolution format than the resolution of the projector 10.

In the embodiment, the SDR video data output1 and the additional data output2 are dispersedly transmitted to different pixel addresses of the 4K image. For example, the high-resolution image is equally divided into four of an upper left, an upper right, a lower left, and a lower right. In an upper-left region 61, the pixel address falls within a range where X=1 to 2048 and Y=1 to 1080. In an upper-right region 62, the pixel address falls within a range where X=2049 to 4096 and Y=1 to 1080. In a lower-left region 63, the pixel address falls within a range where X=1 to 2048 and Y=1081 to 2160. In a lower-right region 64, the pixel address falls within a range where X=2049 to 4096 and Y =1081 to 2160. As described above, the four regions 61 to 64 have the number of pixels for the 2K image, respectively.

Additionally, the mapping unit 42 assigns the SDR video data output1 to the upper-left region 61 of the high-resolution image. In addition, the mapping unit 42 assigns the additional data output2 to the upper-right region 62, the lower-left region 63, and the lower-right region 64. Additional data output2-1 is assigned to the upper-right region 62 in FIG. 14. Additional data output2-2 is assigned to the lower-left region 63. Additional data output2-3 is assigned to the lower-right region 64.

The interface unit 30 has the interface 30*a* that can transmit the 4K image. The interface 30*a* transmits data for all the pixels of the 4K image. Accordingly, the interface 30*a* can transmit the SDR video data output1, and the additional-data output2-1 to output2-3. In this case, the SDR video data output1 and the additional data output2 are alternately transmitted. The projector 10 decodes the SDR video data output1 and the additional data output2-1 to output2-3 that have been dispersed to the different pixel addresses, and thereby generates HDR video data.

The processing unit of the projector 10 generates the HDR video data using the SDR video data output1 and the additional data output2-1 to output2-3 of the corresponding pixel addresses of the four-divided regions. For example, the processing unit of the projector 10 generates HDR video data of a pixel address (1, 1) using the SDR video data of the pixel address (1, 1), the additional data output2-1 of a pixel address (2001, 1), the additional data output2-2 of a pixel address (1, 1001), and the additional data output2-3 of a pixel address (2001, 1001). As described above, the processing unit of the projector 10 generates video data for one pixel in the HDR video using the data for four pixels in the 4K image.

By performing the processing as described above, even in a case where the only one interface 30*a* compliant with the SDR video is provided, the HDR video can be displayed. Further, the additional data can be made to have more bits in the configuration of FIG. 14. Here, the additional data can be made to have three times the number of bits of the SDR video data. In the case of the high-resolution format, an amount that can be handled as difference data can be increased more than a case of a dual-port output (in a case of the 2K input and the 4K output, difference value data of three times as much as that of 2K dual ports can be transferred). Therefore, a bit width of a difference value input (output2) can be made larger.

As a matter of course, the SDR video data output1 and the additional data output2 may have the same bit width. In this case, the mapping unit 42 assigns the SDR video data output1 to a half of the 4K image, and assigns the additional data output2 to the other half. Hereby, the HDR video data of more bits can be transmitted.

If the display system 100 having the one interface 30*a* is employed, the HDR video can be displayed. That is to say, if there is provided the interface 30*a* that can transmit the high-resolution image format, the projector 10 can display HDR video having a low resolution. Consequently, versatility can be more enhanced.

As described above, the processing device 40 generates transmission data including the SDR video data of the smaller number of bits than the number of gradation bits of the HDR video data, based on the HDR video data. Further, the processing device 40 generates from the HDR video data the SDR video data and the additional data added to the SDR video data. Additionally, the interface unit 30 transmits the transmission data. The projector 10 generates the display signal based on the transmission data transmitted through the interface unit 30, and displays the video based on the display signal. Hereby, versatility can be enhanced.

In addition, in any case, processing to generate the SDR video data and the additional data from the HDR video data is the same as each other. The processing in the encoder 41 can be performed in common. Consequently, versatility can be more improved. That is to say, since the processing in the mapping unit 42 may just be changed, processing and configurations can be simplified.

(Dynamic Range Control 1)

Figure 15:
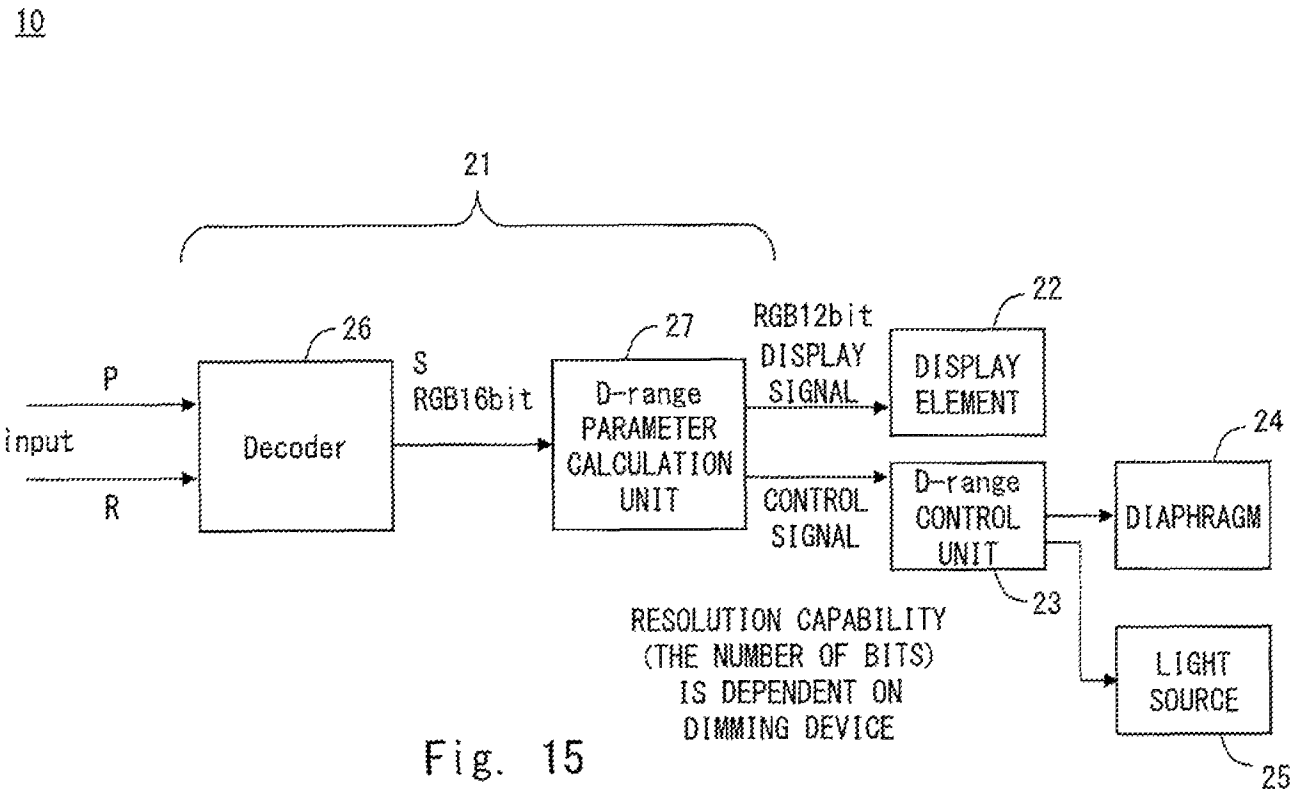
FIG. 15 is a block diagram showing a configuration of a display device that performs dynamic control 1.

Next, one example of dynamic range control (dynamic range control 1) will be explained. FIG. 15 is a block diagram showing a configuration of the projector 10 to perform the control example. Since the basic configuration of the projector 10 shown in FIG. 15 is similar to that of FIG. 6, explanation thereof is appropriately omitted. For example, since a method for generating the HDR video data S from the SDR video data P and the additional data R, explanation thereof is omitted.

At least one of the diaphragm 24 and the light source 25 functions as a dimming device. Here, in a case of the light source 25 is a light source that simultaneously irradiates an entire surface of the display element 22, light cannot be adjusted in a pixel unit even if an opening ratio of the diaphragm 24 is changed. That is to say, since local dimming of the diaphragm 24 and the light source 25 cannot be performed, they are controlled for each frame. That is, the opening ratio of the diaphragm 24 is changed per frame. Accordingly, the opening ratio of the diaphragm 24 becomes constant within one frame.

Additionally, the parameter calculation unit 27 generates a control signal according to a resolution capability of the dimming device. Here, there will be explained an example where the diaphragm 24 functions as a dimming device having a 4-bit resolution capability. Specifically, the opening ratio of the diaphragm 24 can be controlled in sixteen stages. The opening ratio of the diaphragm 24 is controlled based on a 4-bit control signal.

FIG. 16 is a table showing a relation between the control signal and the opening ratio (a light-emitting amount) of the diaphragm 24. As shown in FIG. 16, the opening ratio (OUT) of the diaphragm 24 changes according to a value of the 4-bit control signal (IN). When a value of the control signal is 15, the opening ratio of the diaphragm 24 becomes a maximum. Note that a maximum value of the opening ratio of the diaphragm 24 is normalized as 1. The opening ratio of the diaphragm 24 becomes smaller as the value of the control signal becomes smaller. In a case where the value of the control signal is 0, the opening ratio of the diaphragm then becomes 0.1. That is to say, a brightness in the case where the value of the control signal is 15 is ten times as large as in the case where the value of the control signal is 0.

The control signal, for example, can be high-order 4 bits of the HDR video data S that takes a maximum value within one frame. That is to say, a value of the high-order 4 bits of a pixel that takes the maximum value serves as the control signal. Alternatively, the control signal may be high-order 4 bits of an average value of the HDR video data S within one frame. Alternatively, high-order 4 bits of a local average value may be set as the control signal. As described above, the control signal is decided by the maximum value or the average value. Note that a decision technique of the control signal is according to a display application.

Additionally, if the parameter calculation unit 27 decides the value of the control signal, it sets a display signal of each pixel. The parameter calculation unit 27 converts 16-bit HDR video data S into a 12-bit display signal (4096 gradation value) for each pixel. For example, the parameter calculation unit 27 generates the 12-bit display signal based on low-order 12 bits of the 16-bit HDR video data S. Hereby, the display element 22 modulates a light for each pixel based on a 12-bit gradation value of the 12-bit display signal.

The parameter calculation unit 27 generates the control signal and the display signal based on the HDR video data S. Since the display element 22 can control drive of 4096 gradations (12 bits), the display signal output to the display element 22 is also 12 bits.

Figure 17:
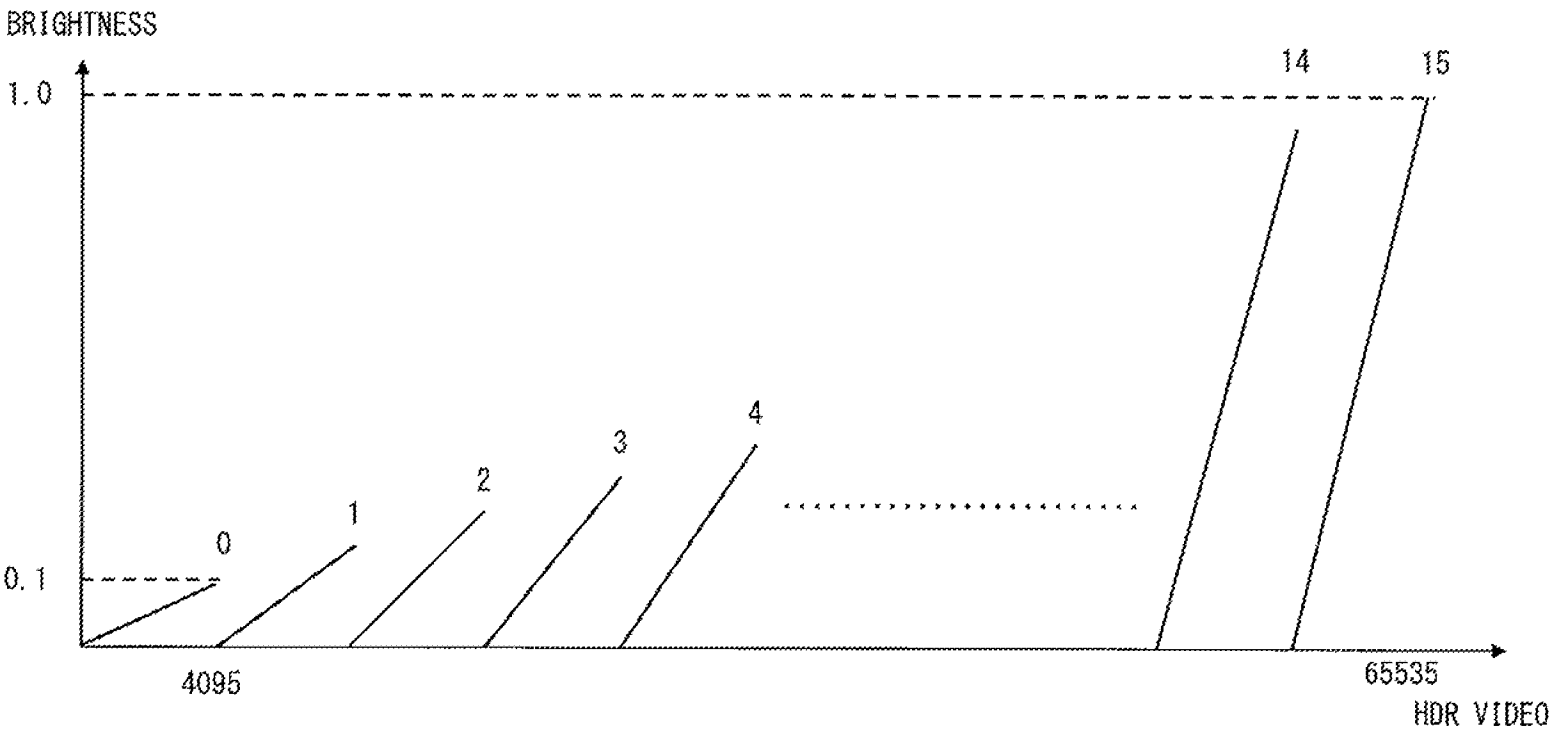
FIG. 17 is a graph showing luminance values and brightnesses of HDR video data S.

A relation between the HDR video data S and the brightness will be explained based on FIG. 17. In FIG. 17, a horizontal axis indicates the HDR video data S, and a vertical axis indicates the brightness (a relative value) of a display image. In FIG. 17, the relation between the HDR video data S and the brightness is shown by different straight lines according to values of the control signal. Specifically, the values (0 to 4, 14, and 15 in FIG. 17) of the control signal are given to the respective straight lines.

Assume that the value of the control signal increases 1 by 1 for each 4096 gradations to thereby correspond to the 16-bit gradation of the HDR video data S. For example, a case is considered where the control signal is decided by the above-described maximum value of the HDR video data within one frame. In a case where the maximum value of the HDR video data S ranges from 0 to 4095, the value of the control signal is 0, while in a case where the maximum value of the HDR video data S ranges from 4096 to 8191, the value of the control signal is 1. Additionally, brightnesses from 0 to a maximum are represented by 12-bit gradation in the value of each control signal. In a case where the value of the control signal is 0, 0 to 4095 are assigned to 12 bits, while in a case where the value of the control signal is 1, 0 to 8191 are assigned to the 12 bits. Here, since the diaphragm 24 adjusts the light for each frame, gradations of all the pixels of one frame period are represented by one straight line based on the value of one control signal.

For example, the parameter calculation unit 27 generates the display signal and the control signal by calculation shown below. First, the parameter calculation unit 27 acquires brightness data B1 of a right column of FIG. 16 from the MSB 4 bits of the HDR video data S to be used as the control signal. The parameter calculation unit 27 then compares the brightness data B1 with brightness data B2 of the MSB 4 bits of the respective pixel data, and thereby calculates a ratio (B2/B1) to the brightness to be controlled. The parameter calculation unit 27 decides the display signal by multiplying a signal of the LSB 12 bits of the HDR video data S by the calculated ratio value.

For example, assume that a pixel 1 is 1111000000000000, and that a pixel 2 is 0000111111111111. Note that the HDR video data S is 1111111111111111 in the brightest pixel. According to FIG. 16, the brightness B2 is 1.0 in the pixel 1, and the brightness B2 is 0.1 in the pixel 2. Consequently, the brightness ratio (B2/B1) of the pixel 2 is (0.1/1.0)=0.1. Here, low-order 13 bits are extracted, calculated, and converted into 12 bits, whereby display signals of the pixel 1 and the pixel 2 are calculated. As the display signal of the pixel 1, it is established that 4096 (1000000000000)×1.0/2=2048 (100000000000), while as the display signal of the pixel 2, it is established that 4095 (0111111111111))×0.1/2≈205 (000011001101). Such calculation corresponds to processing to reshake 12-divided gradations of FIG. 17.

The larger the value of the control signal becomes, the steeper a slope of the straight line becomes. In other words, the larger the value of the control signal becomes, the wider a dynamic range of the brightness can be made. For example, when the value of the control signal is 15, the HDR video can be displayed with the maximum brightness. That is to say, dynamic ranges of brightnesses 0 to 1 can be displayed by the 12-bit gradation. In addition, when the value of the control signal is 0, dynamic ranges of brightnesses 0 to 0.1 can be displayed by the 12-bit gradation. Consequently, low-luminance gradations can be represented more finely.

As described above, since a lot of gradations can be assigned to the low-luminance gradations, more appropriate display for eyes of human being sensitive to the low-luminance gradations can be performed.

Note that D-range control by the light source 25 can make a ratio (a contrast) between a maximum amount of light and a minimum amount of light larger than that by the diaphragm 24. Furthermore, it is also possible to perform the D-range control for each region obtained by dividing one frame into plural instead of the D-range control for each frame. In addition, the number of bits of the control signal is not limited to 4 bits. The number of bits of the control signal may be set according to performance of the diaphragm 24 and the light source 25.

Figure 18:
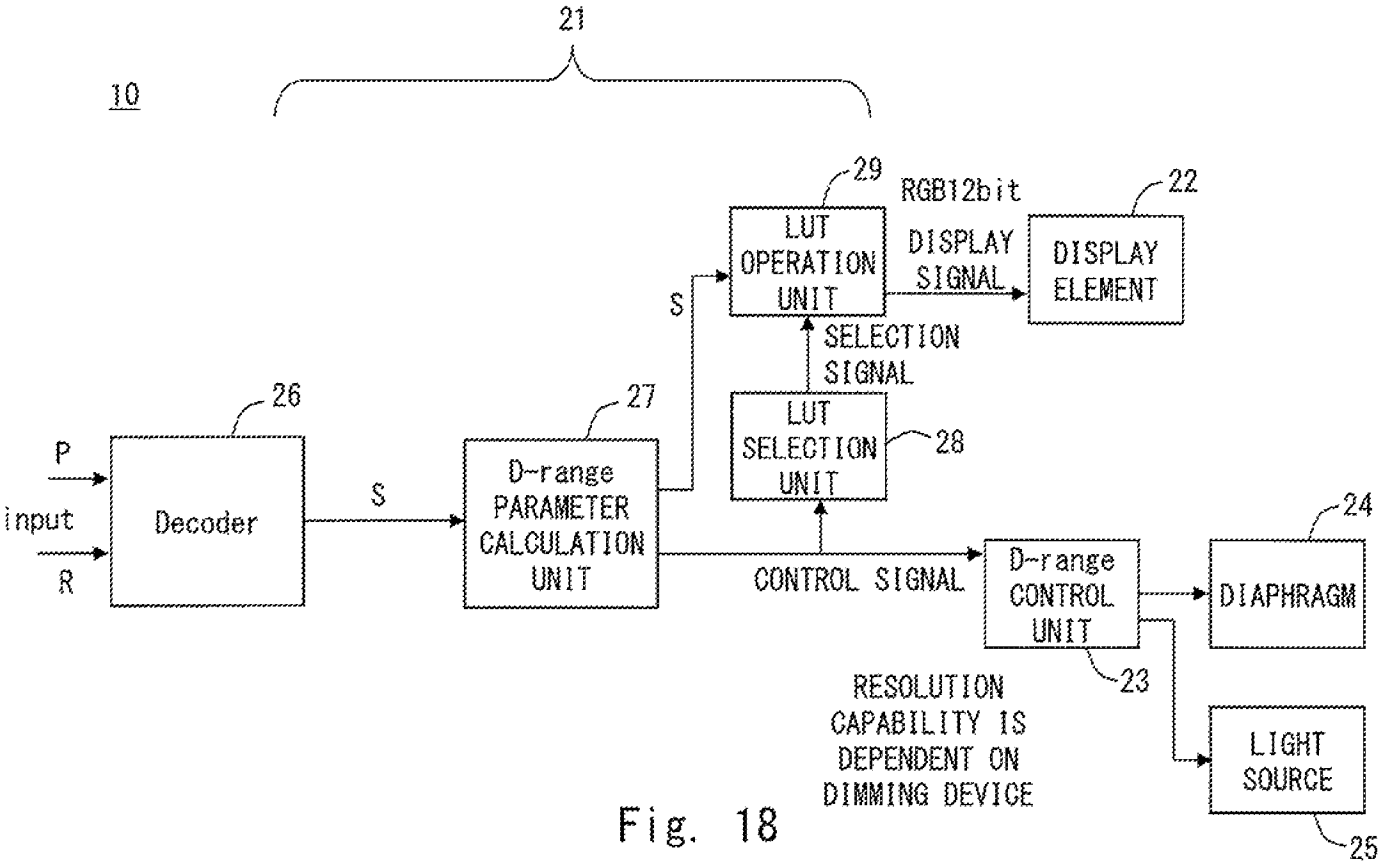
FIG. 18 is a control block diagram showing control to generate a control signal and a display signal from the HDR video data S using an LUT.

Although the opening ratio of the diaphragm 24 to the control signal is set to be linear in the above explanation, it may be non-linear. Using FIG. 18, there will be explained control in a case where light adjustment by the dimming device is non-linear to the signal. In a case of being non-linear, the parameter calculation unit 27 generates a display signal using a lookup table (LUT).

Specifically, the parameter calculation unit 27 first generates a control signal according to the high-order 4 bits of the HDR video data S. The parameter calculation unit 27 then outputs the control signal to the D-Range control unit 23 as described above. Since control by the D-Range control unit 23 is similar to the above, explanation thereof is omitted.

Further, the parameter calculation unit 27 outputs the control signal to an LUT selection unit 28. The LUT selection unit 28 outputs a selection signal for selecting the LUT, according to a value of the control signal. The number of LUTs according to the number of bits of the control signal is previously stored in the memory etc. For example, in a case where the control signal is 4 bits, sixteen LUTs are stored in the LUT selection unit 28. The LUT selection unit 28 then selects the LUT corresponding to the value of the control signal from the previously stored plurality of LUTs.

The HDR video data S and the display signal are associated with the LUT. An LUT operation unit 29 generates a 12-bit display signal based on the HDR video data S. That is to say, the LUT operation unit 29 converts a value of the HDR video data S into a 12-bit value with reference to the selected LUT. Hereby, the 12-bit display signal is generated.

In addition, the control signal can be made to have the number of bits according to the resolution capability of the dimming device. For example, in a case where the resolution capability of the dimming device is 1 bit and where, for example, the diaphragm 24 or the light source 25 adjusts light in two stages, the control signal can also be set as 1 bit. In addition, both the diaphragm 24 and the light source 25 may be used as the dimming devices. In this case, the control signal may be assigned to the diaphragm 24 and the light source 25.

Further, in a case of performing display on a general-purpose display without a dimming device, the LUT is fixed. That is to say, the LUT selection unit 28 selects one LUT regardless of the value of the HDR video data S. The LUT serves as tone mapping data for converting the HDR video data S into the SDR video data. Additionally, the LUT operation unit 29 may just generate the display signal according to the number of bits of the display element 22.

The above-described processing may be performed by the projector 10 or the processing device 40. In a case where the processing device 40 performs the processing, the processing device 40 performs the processing according to performance of the connected projector 10. The processing device 40 specifies a model of the projector 10 using EDID (Extended Display Identified Data) output from the projector 10. The number of bits of the display signal and the control signal are then decided according to the specified model. The processing device 40 may just transmit the control signal and the display signal to the projector 10 through dual ports.

(Dynamic Range Control 2)

Figure 19:
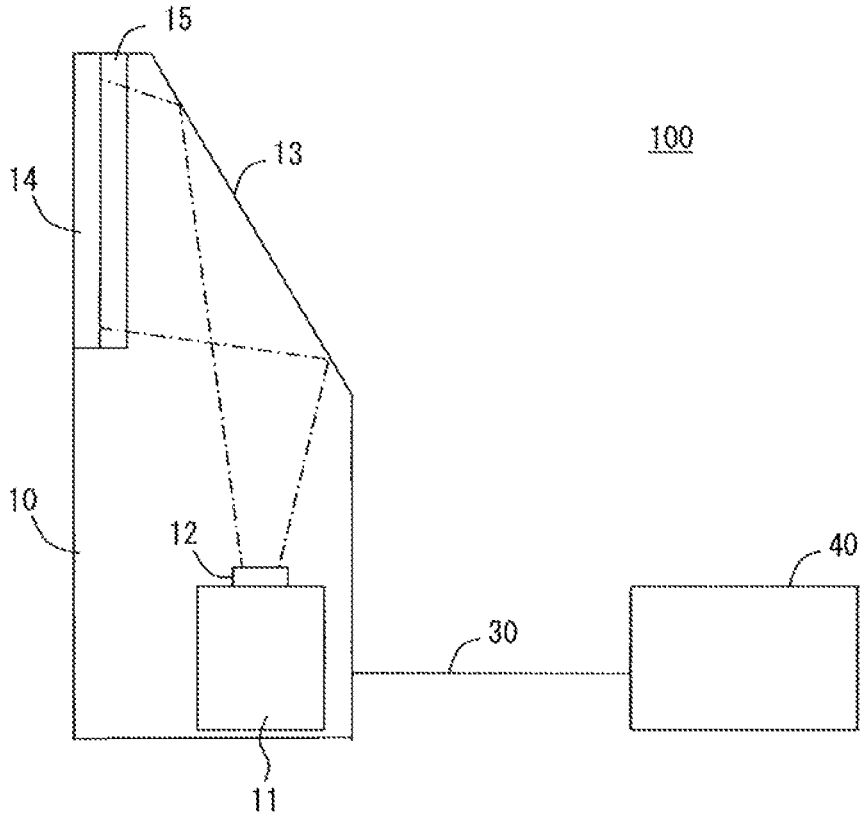
FIG. 19 is a diagram showing an overall configuration of a display system that performs dynamic control 2.
Figure 20:
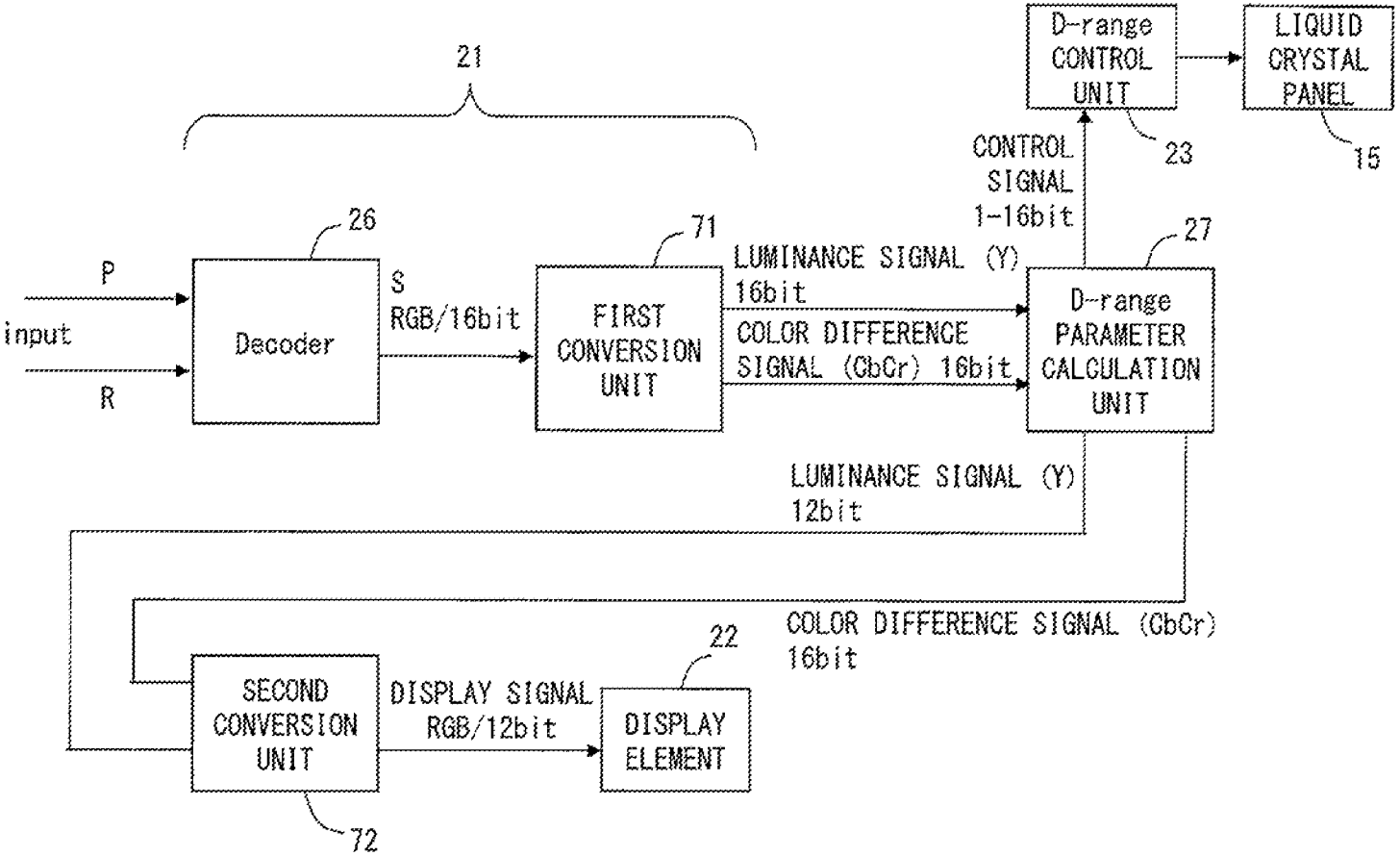
FIG. 20 is a control block diagram showing a control configuration of the display system that performs the dynamic control 2.

Next, an example of another dynamic range control (dynamic range control 2) will be explained using FIGS. 19 and 20. FIG. 19 is a diagram showing an overall configuration of the display system 100. In the dynamic range control 2, a liquid crystal panel 15 is added to the display system 100 of FIG. 1. That is to say, a light from the projection unit 11 is projected on the screen 14 through the liquid crystal panel 15. Note that since configurations other than the liquid crystal panel 15, and basic control are similar to the above, explanation thereof is omitted.

The liquid crystal panel 15 functions as a dimming device that can perform local dimming. For example, the liquid crystal panel 15 has a plurality of pixels. The liquid crystal panel 15 controls an amount of passing light that goes toward the screen 14 from the projection unit 11 for each pixel. Further, the liquid crystal panel 15 controls an amount of transmission light for each pixel according to the control signal. Pixels of the liquid crystal panel 15 correspond to pixels of the projection unit 11. Consequently, the liquid crystal panel 15 performs gradation control of the pixels according to the control signal, and thereby the dynamic range can be made wide. Here, the liquid crystal panel 15 is not compliant with color display of RGB. The liquid crystal panel 15 performs luminance modulation according to a luminance signal (Y) instead of an RGB signal as explained below. Note that although the transmission-type liquid crystal panel 15 is used in FIG. 19, a reflection-type liquid crystal panel 15 may be used as shown in Japanese Unexamined Patent Application Publication No. 2007-310045.

The decoder 26 outputs the HDR video data S to a first conversion unit 71. The HDR video data S is a 16-bit RGB signal. The first conversion unit 71 converts the HDR video data S into the luminance signal (Y) and a color difference signal (CbCr). Since the HDR video data S is 16 bits, the luminance signal (Y) and the color difference signal (CbCr) are also 16 bits. The first conversion unit 71 outputs the 16-bit luminance signal (Y) and color difference signal (CbCr) to the parameter calculation unit 27.

The parameter calculation unit 27 generates a control signal according to the luminance signal (Y). Here, the parameter calculation unit 27 generates the control signal according to an MSB-side bit of the luminance signal (Y). That is to say, in the case where the control signal is 4 bits, the parameter calculation unit 27 creates the control signal according to the MSB-side 4 bits of the luminance signal (Y). The number of bits of the control signal is a value according to the number of gradations of the liquid crystal panel 15.

The parameter calculation unit 27 outputs the control signal to the D-Range control unit 23. The D-Range control unit 23 outputs a drive signal for driving each pixel of the liquid crystal panel 15, based on the control signal. Hereby, each pixel of the liquid crystal panel 15 is driven. That is to say, the liquid crystal panel 15 performs luminance modulation according to the luminance signal (Y). Accordingly, the liquid crystal panel 15 controls a luminance (a gradation) of each pixel based on the drive signal.

Further, the parameter calculation unit 27 outputs the 12-bit luminance signal (Y) and the 16-bit color difference signal (CbCr) to a second conversion unit 72. The second conversion unit 72 converts the luminance signal (Y) and the color difference signal (CbCr) into a display signal of RGB. That is to say, the second conversion unit 72 generates the display signal based on the luminance signal (Y) and the color difference signal (CbCr). Note that the luminance signal (Y) output from the parameter calculation unit 27 is 12 bits in accordance with the number of bits of the display signal. The display element 22 performs color image display according to the 12-bit display signal as described above.

The projection unit 11 of the display element 22 projects an image on the screen 14 through the liquid crystal panel 15. The liquid crystal panel 15 performs gradation control as described above. Hereby, a light amount of a projection light from the projection unit 11 is controlled in the liquid crystal panel 15. Consequently, the dynamic range can be made wide. In addition, the liquid crystal panel 15 is made to have more gradations, and thereby images can be displayed with more definition. For example, in the case where the HDR video data S is 16 bits, the display signal may be set as the 12-bit RGB signal, and the liquid crystal panel 15 as the 8-bit luminance signal (Y). In this case, the HDR video data S may just be represented using a total of 20 bits.

Figure 21:
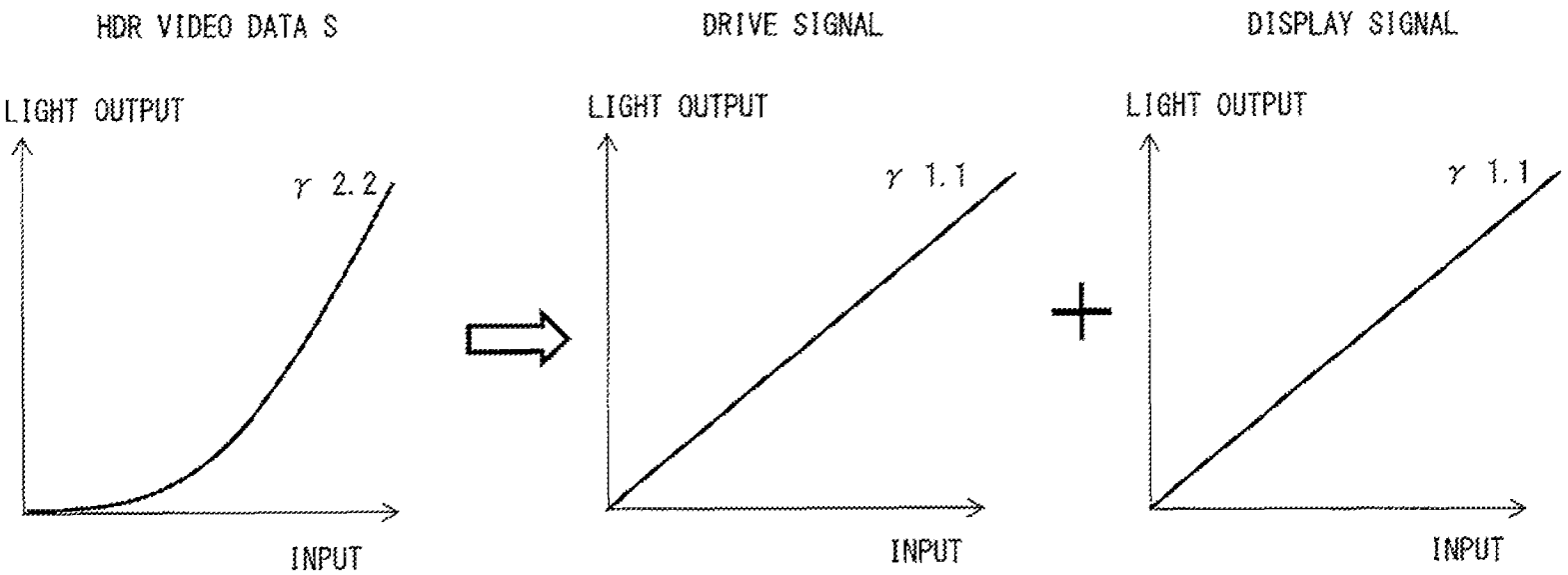
FIG. 21 shows graphs for explaining one example of gamma characteristics of a projector 10, a projection unit 11, and a liquid crystal panel 15.

The luminance signal (Y) may be linear or may be multiplied by a gamma value. Using FIG. 21, there will be explained gamma correction in a case of using the liquid crystal panel 15 and the projection unit 11. In FIG. 21, a horizontal axis indicates an input value, and a vertical axis indicates an optical output (a luminance). The control example will be explained assuming that a gamma value of the projector 10 is 2.2.

The HDR video data S to be input is divided into two in the embodiment. Additionally, as shown in FIG. 21, a gamma characteristic of the projection unit 11 is set to be 1.1, and a gamma characteristic of the liquid crystal panel 15 is set to be 1.1. Additionally, the display signal to be input to the projection unit 11 and the drive signal to be input to the liquid crystal panel 15 are generated by adjusting the gamma values. For example, a lookup table can be used for generating the display signal and the drive signal.

Note that the gamma characteristics of the projection unit 11 and the liquid crystal panel 15 are not limited to these values. That is to say, a sum of a gamma value in a first output characteristic and a gamma value in a second output characteristic may just be equal to the gamma value of the projector 10. As described above, the parameter calculation unit 27 may just generate the drive signal and the display signal in consideration of the gamma characteristics.

Figure 22:
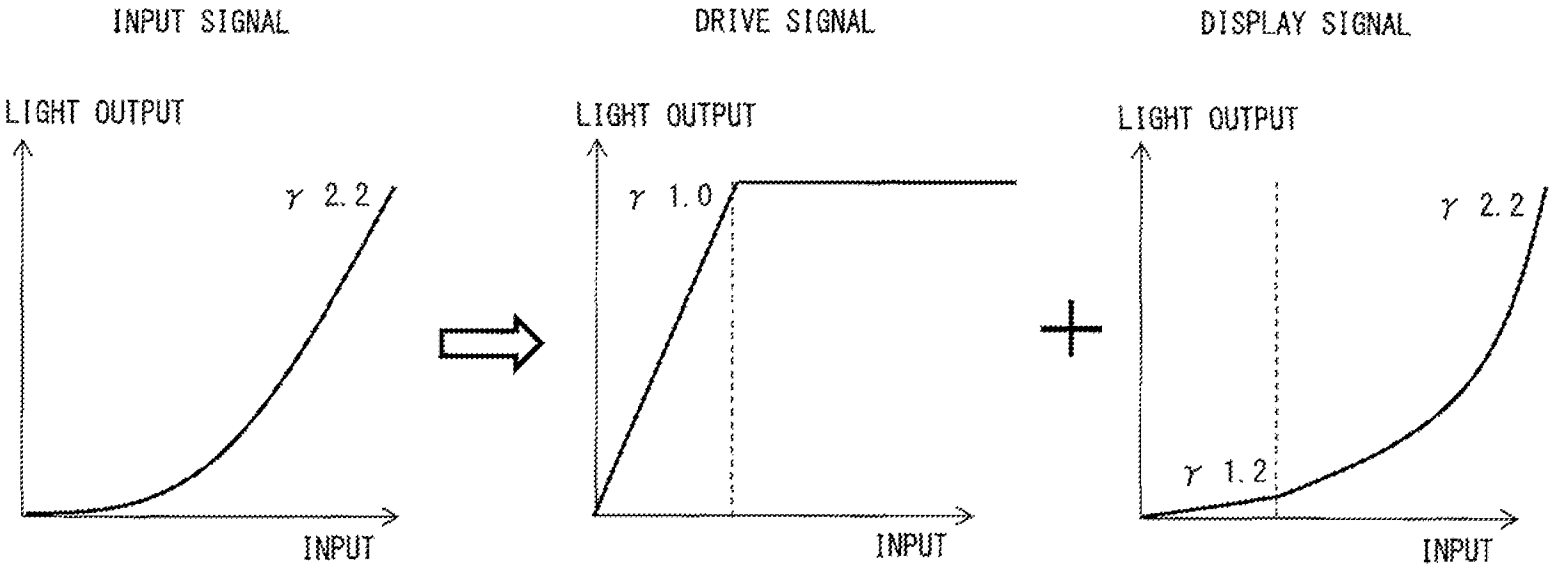
FIG. 22 shows graphs for explaining another example of the gamma characteristics of the projector 10, the projection unit 11, and the liquid crystal panel 15.

FIG. 22 shows one example in a case where modulation of the liquid crystal panel 15 is limited to a predetermined range of a dark portion side. The example shown in FIG. 22 is an example where a gamma value of an output characteristic of the projection unit 11 is set to be 2.2 (however, the gamma value is 1.2 in a case where an input is equal to or smaller than 0.25), and where the gamma value of the liquid crystal panel 15 is set to be 1, in a case where the gamma value of the gamma characteristic of the projector 10 is prescribed as 2.2. In addition, in the gamma characteristic of the liquid crystal panel 15, an amount of light output is uniformly a maximum in a case where an input value is equal to or larger than 0.25. As described above, in the output characteristic of the liquid crystal panel 15, an output may be fixed to a maximum value in a case where the input value is equal to or larger than a predetermined value. Hereby, all gradations of the liquid crystal panel 15 can be assigned to a gamma region where the input value is equal to or smaller than 0.25, and gradations of the dark portion side can be represented with finer gradations. Note that each embodiment and each Example can be appropriately combined with each other.

The whole or part of the image processing described above may be implemented by a computer program. The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable media. Examples of transitory computer readable media include electric signals, optical signals, and electromagnetic waves. Transitory computer readable media can provide the program to a computer via a wired communication line, such as electric wires and optical fibers, or a wireless communication line.

While the invention made by the present inventor has been described in detail above with reference to exemplary embodiments, the present invention is not limited to the above exemplary embodiments and can be modified in various manners without departing from the scope of the invention.

What is claimed is:

1. A display signal processing system comprising:

a processing device configured to process a video signal to generate a transmission signal;

an interface unit configured to transmit the transmission signal; and a display signal generation device configured to generate a display signal based on the transmission signal, wherein the processing device includes:

a converter configured to generate low-bit video data by decimating gradations of the video signal;

an additional data calculation unit configured to generate additional data based on information of the decimated gradations; and a mapping unit configured to generate the transmission signal including the low-bit video data and the additional data, and the transmission signal being compliant with the interface unit, and the display signal generation device includes a processor configured to restore at least a part of the decimated gradations in the low-bit video data based on the transmission signal to thereby generate the display signal.

2. The display signal processing system according to claim 1, wherein the interface unit includes: a first interface configured to transmit first transmission data including the low-bit video data; and a second interface configured to transmit second transmission data including the additional data.

3. The display signal processing system according to claim 1, wherein an interface of the interface unit can transmit a three-dimensional image generated by synthesizing a left image and a right image, and the low-bit video data is assigned to one of the left image and the right image, and the additional data is assigned to the other thereof.

4. The display signal processing system according to claim 1, wherein an interface of the interface unit can transmit a high-resolution image having a resolution higher than that of the video signal, and the low-bit video data and the additional data are dispersed to different pixel addresses of the high-resolution image.

5. The display signal processing system according to claim 1, wherein the display signal generation device further includes:

a display unit configured to display a video based on the display signal;

a luminance adjustment unit configured to adjust a luminance of the video to be displayed; and a plurality of display elements configured to perform gradation display of the video to be displayed, the processor is configured to divide the display signal into high-order-bit-side data and low-order-bit-side data, the luminance adjustment unit is configured to adjust the luminance of the video based on the high-order-bit-side data, and the display elements are configured to perform gradation display of the video based on the low-order-bit-side data.

6. The display signal processing system according to claim 1, wherein the converter is configured to generate the low-bit video data by decimating gradations of the video signal when the video signal is less than a predetermined level, and is configured to make the predetermined level of data into the low-bit video data when the video signal is equal to or larger than the predetermined level, and the additional data calculation unit is configured to generate the additional data based on information of the decimated gradations when the video signal is less than the predetermined level, and is configured to make data from which the gradations of the video signal have been decimated into the additional data when the video signal is equal to or larger than the predetermined level.

7. A processing device comprising:

a converter configured to generate low-bit video data by decimating gradations of a video signal;

an additional data calculation unit configured to generate additional data based on information of the decimated gradations; and a mapping unit configured to generate a transmission signal including the low-bit video data and the additional data, and the transmission signal being compliant with an interface unit configured to transmit the transmission signal, wherein a display signal is generated based on restoring at least a part of the decimated gradations in the low-bit video data based on the transmission signal.

8. A display signal processing method comprising:

generating low-bit video data by decimating gradations of a video signal;

generating additional data based on information of the decimated gradations;

generating a transmission signal that includes the low-bit video data and the additional data, and the transmission signal being compliant with an interface unit configured to transmit the transmission signal; and restoring at least a part of the decimated gradations in the low-bit video data based on the transmission signal to thereby generate a display signal.

9. A processing method comprising:

generating low-bit video data by decimating gradations of a video signal;

generating additional data based on information of the decimated gradations; and generating a transmission signal that includes the low-bit video data and the additional data, and the transmission signal being compliant with an interface unit configured to transmit the transmission signal, wherein a display signal is generated based on restoring at least a part of the decimated gradations in the low-bit video data based on the transmission signal.

* * * * *